US010429759B2

(12) United States Patent
Ishidate et al.

(10) Patent No.: US 10,429,759 B2
(45) Date of Patent: Oct. 1, 2019

(54) IMAGE FORMING APPARATUS HAVING OPTICAL PRINT HEAD

(71) Applicant: CANON KABUSHIKI KAISHA, Tokyo (JP)

(72) Inventors: Takehiro Ishidate, Tokyo (JP); Hitoshi Iwai, Abiko (JP); Toshiki Momoka, Tokyo (JP); Shinichiro Hosoi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/001,508

(22) Filed: Jun. 6, 2018

(65) Prior Publication Data

US 2018/0364612 A1 Dec. 20, 2018

(30) Foreign Application Priority Data

Jun. 16, 2017 (JP) ..... 2017-119000

(51) Int. Cl.
*G03G 15/00* (2006.01)
*G03G 21/16* (2006.01)
*G03G 15/04* (2006.01)

(52) U.S. Cl.
CPC ... *G03G 15/04036* (2013.01); *G03G 21/1647* (2013.01); *G03G 21/1666* (2013.01); *G03G 2221/1654* (2013.01)

(58) Field of Classification Search
CPC ..... G03G 15/04036; G03G 15/04054; G03G 21/16; G03G 21/1666; G03G 21/1647; G03G 2221/1654; B41J 25/304
See application file for complete search history.

(56) References Cited

U.S. PATENT DOCUMENTS

| | | | | |
|---|---|---|---|---|
| 8,112,012 | B2 | 2/2012 | Wong et al. | |
| 8,269,812 | B2 | 9/2012 | Morimoto et al. | |
| 8,305,419 | B2 | 11/2012 | Morita | |
| 8,725,028 | B2 | 5/2014 | Imai | |
| 2007/0024943 | A1 | 2/2007 | Namba | |
| 2007/0126852 | A1* | 6/2007 | Fukutome | B41J 25/304 347/262 |
| 2010/0245525 | A1 | 9/2010 | Morimoto et al. | |
| 2010/0271639 | A1 | 10/2010 | Iijima | |
| 2011/0050834 | A1 | 3/2011 | Umezawa | |
| 2012/0177418 | A1 | 7/2012 | Hashiyada et al. | |
| 2012/0207511 | A1 | 8/2012 | Sato et al. | |

(Continued)

FOREIGN PATENT DOCUMENTS

| | | | |
|---|---|---|---|
| JP | 2006258909 | A | 9/2006 |
| JP | 2007072321 | A | 3/2007 |

(Continued)

*Primary Examiner* — Sophia S Chen
(74) *Attorney, Agent, or Firm* — Canon U.S.A., Inc. IP Division

(57) ABSTRACT

A holding member that holds an optical print head for exposing a photosensitive drum is provided with one abutting pin at each end thereof in the longitudinal direction. Each abutting pin has both a function of forming a gap between the optical print head and the photosensitive drum, and a function of restricting movement of the holding member in the X direction and Y direction. The holding member is supported by a link member further toward the side of the photosensitive drum than the lower end portion of the abutting pins.

20 Claims, 26 Drawing Sheets

(56) References Cited

U.S. PATENT DOCUMENTS

| | | | | |
|---|---|---|---|---|
| 2013/0164027 | A1 | 6/2013 | Sato et al. | |
| 2013/0170855 | A1* | 7/2013 | Mori | G03G 21/1666 399/110 |
| 2013/0194369 | A1 | 8/2013 | Shimamoto | |
| 2014/0212170 | A1* | 7/2014 | Kato | G03G 21/1666 399/118 |
| 2015/0050043 | A1* | 2/2015 | Sato | G03G 21/1666 399/110 |
| 2015/0109398 | A1 | 4/2015 | Park et al. | |
| 2018/0095405 | A1* | 4/2018 | Iwai | G03G 15/04054 |

FOREIGN PATENT DOCUMENTS

| | | | |
|---|---|---|---|
| JP | 2010230954 | A | 10/2010 |
| JP | 2011020414 | A | 2/2011 |
| JP | 2013134370 | A | 7/2013 |
| JP | 2014213541 | A | 11/2014 |
| JP | 2015018132 | A | 1/2015 |

* cited by examiner

FIG. 5A
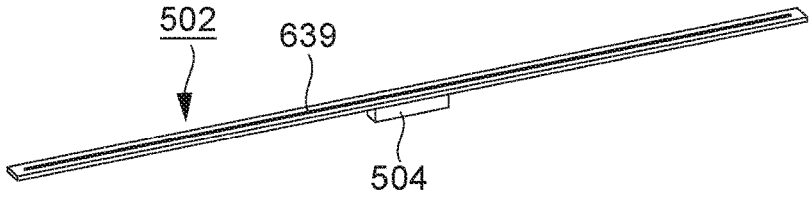
FIG. 5B1
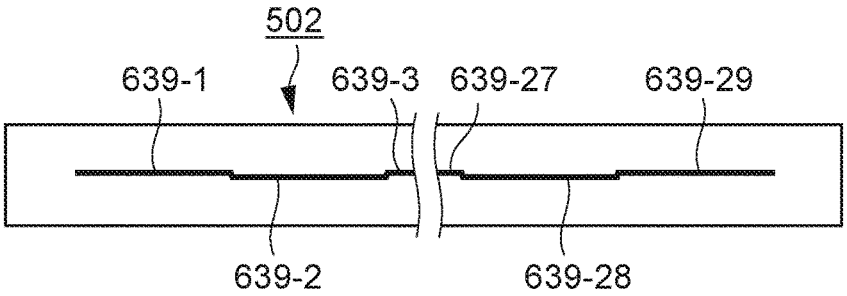
FIG. 5B2
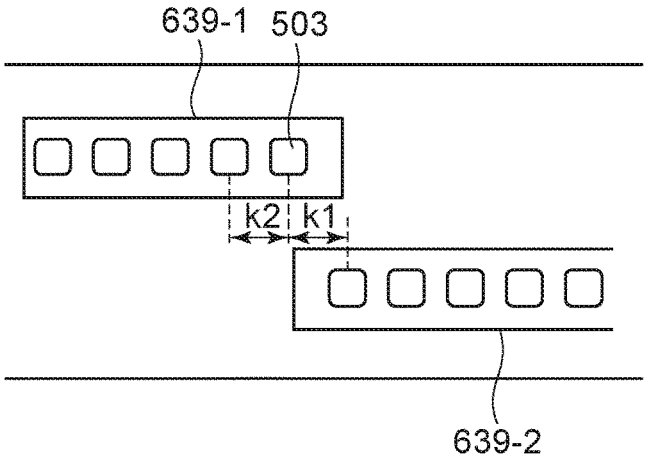
FIG. 5C1
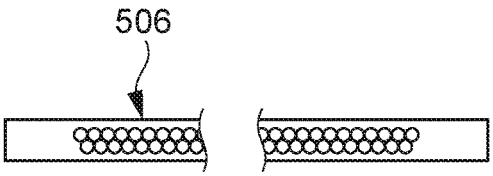
FIG. 5C2
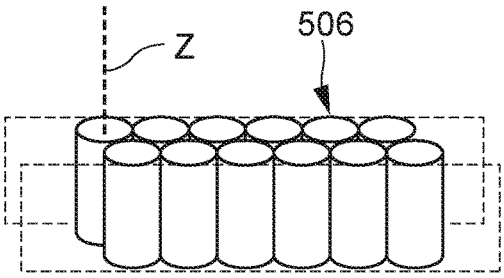

FIG. 7A1
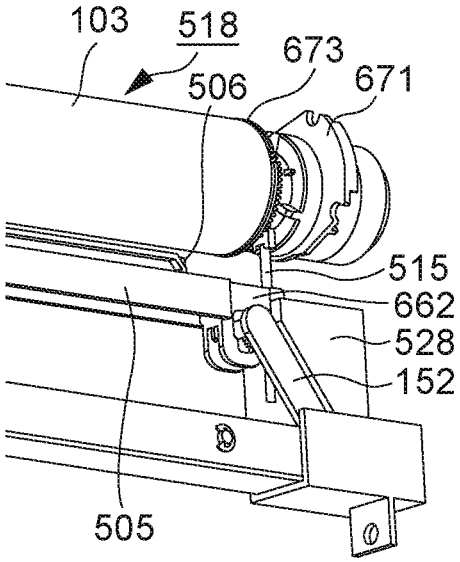
FIG. 7A2
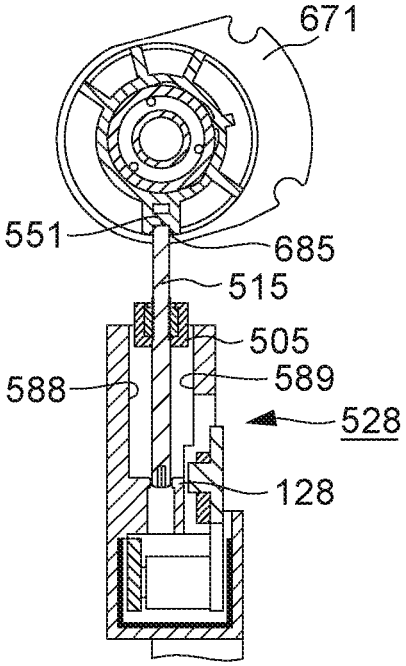
FIG. 7B1
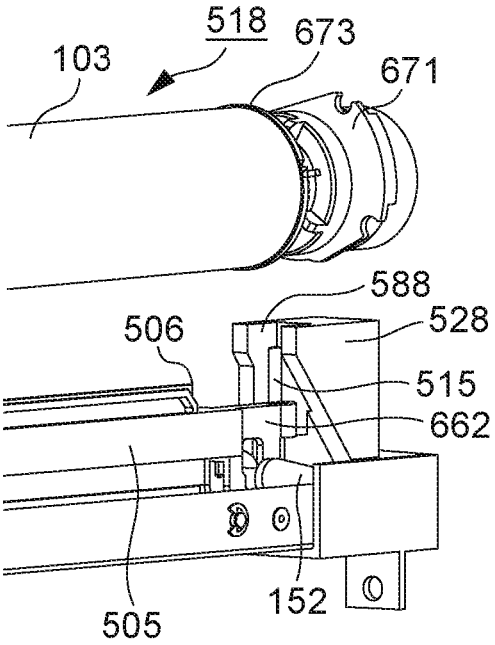
FIG. 7B2
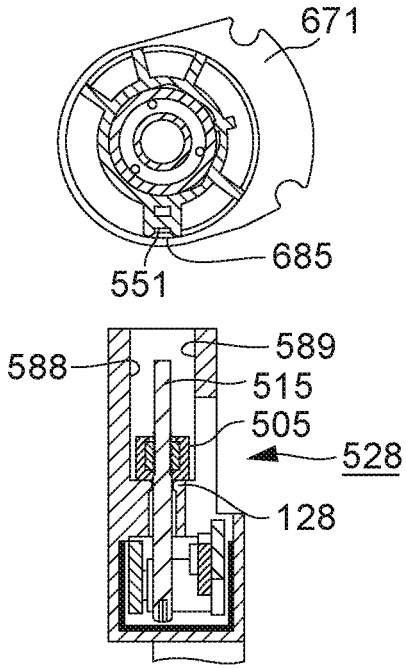

FIG. 16A1
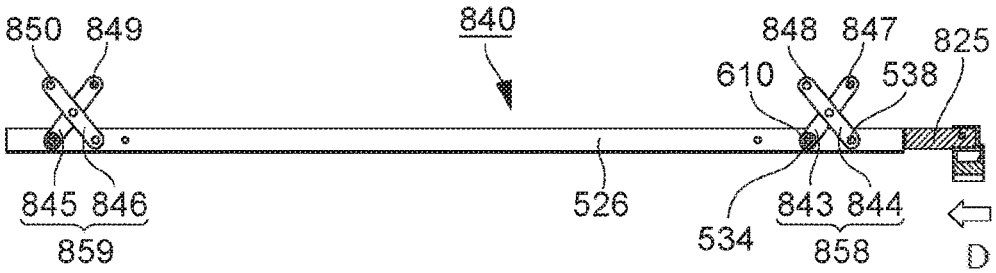
FIG. 16A2
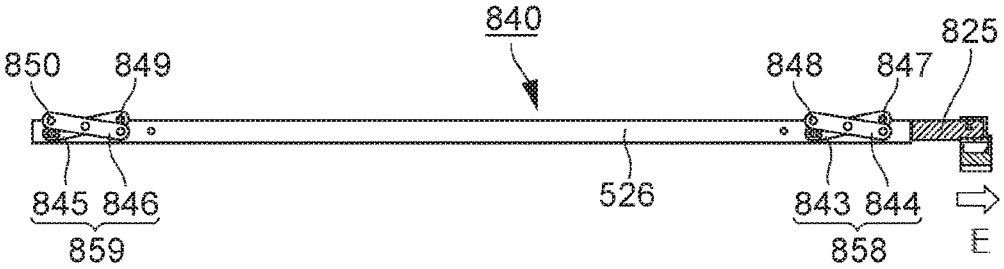
FIG. 16B
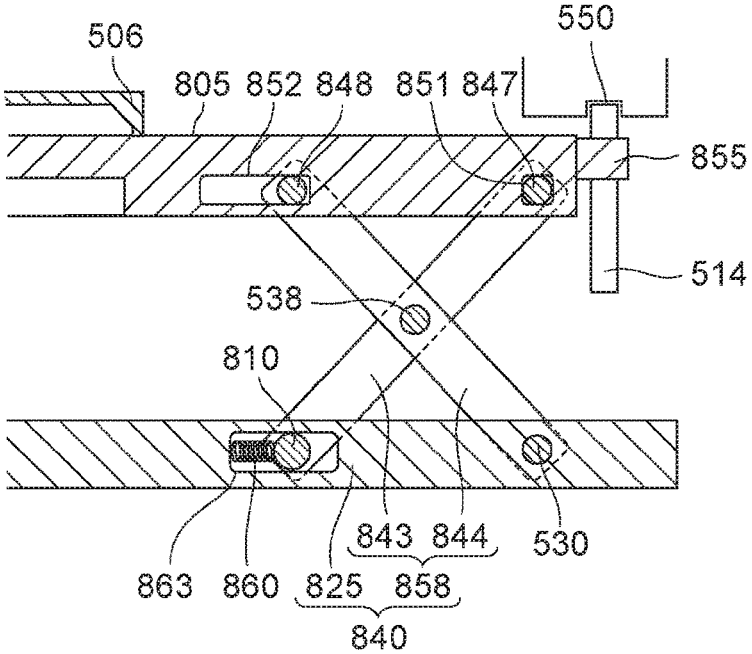

IMAGE FORMING APPARATUS HAVING OPTICAL PRINT HEAD

BACKGROUND OF THE INVENTION

Field of the Invention

The present invention relates to an image forming apparatus having an optical print head that reciprocally moves between an exposure position where light-emitting elements expose a photosensitive drum, and a retracted position where the optical print head is retracted from a replacement unit including the photosensitive drum.

Description of the Related Art

Image forming apparatuses such as printers, copying machines, and so forth, have an optical print head that has multiple light-emitting elements for exposing a photosensitive drum. Some optical print heads use light-emitting diodes (LEDs) or organic electroluminescence (EL) devices or the like, which are examples of light-emitting elements. There are known arrangements where multiple such light-emitting elements are arrayed in one row or two staggered rows, for example, in the rotational axis direction of the photosensitive drum. Optical print heads also have multiple lenses for condensing light emitted from the multiple light-emitting elements onto the photosensitive drum. The multiple lenses are disposed facing the surface of the photosensitive drum, having been arrayed in the direction of array of the light-emitting elements, between the multiple light-emitting elements and the photosensitive drum. Light emitted from the multiple light-emitting elements is condensed on the surface of the photosensitive drum through the lenses, and an electrostatic latent image is formed on the photosensitive drum.

The photosensitive drum is a consumable item, and accordingly is periodically replaced. A worker performing the work of replacing a photosensitive drum or the like can perform maintenance of the image forming apparatus by replacing the replacement unit containing the photosensitive drum. The replacement unit has a configuration where it is detachably mountable to a main body of the image forming apparatus, by being extracted from and inserted to the apparatus main body from the side face of the image forming apparatus by sliding movement. The clearance between the lenses and the surface of the photosensitive drum is extremely narrow at an exposure position of the optical print head for when exposing the photosensitive drum (a position near to and facing the surface of the drum). Accordingly, the optical print head needs to be retracted from the exposure position when replacing the replacement unit, lest the optical print head and photosensitive drum or the like come into contact and the surface of the photosensitive drum and the lenses be damaged. Accordingly, a mechanism needs to be provided to the image forming apparatus where the optical print head is reciprocally moved between the exposure position and a retracted position where the optical print head is further distanced from the replacement unit than the exposure position, in order to mount/detach the replacement unit.

Japanese Patent Laid-Open No. 2014-213541 discloses an advancing/retreating mechanism that reciprocally moves an optical print head between the exposure position and retracted position. An LED print head disclosed in Japanese Patent Laid-Open No. 2014-213541 has a housing having light-emitting elements that expose a photosensitive drum.

The housing has a first front positioning pin at the one side in the X-axis direction and a first rear positioning pin at the other end. The housing 61 also has a second front positioning pin further toward the one end side than the first front positioning pin, and a second rear positioning pin further toward the other end side than the first rear positioning pin. The advancing/retreating mechanism has a lever, a cam, a lifting and lowering portion, and the supporting portion. When the lever is moved in a direction of arrow (FIG. 7 of Japanese Patent Laid-Open No. 2014-213541), the cam pivots, and the lifting and lowering portion is moved toward the photosensitive drum. The supporting portion is provided to the lifting and lowering portion. The supporting portion pushes the first front positioning pin has upwards, and the LED print head moves from the retracted position toward the exposure position. A gap is formed between the photosensitive drum and the LED print head by the first front positioning pin and the first rear positioning pin abutting a front ball bearing and a rear ball bearing rotatably supporting the photosensitive drum, whereby the LED print head is brought to the exposure position.

A front restricting member and a front positioning member are disposed at the one end side of the housing, and a rear positioning member is disposed at the one end side of the housing. Movement of the second front positioning pin in the X direction and Y direction is restricted by the front restricting member and front positioning member, and movement of the second rear positioning pin in the Y direction is restricted by the rear positioning member. Accordingly, movement in the X direction and Y direction of the housing that is integral with the second front positioning pin and second rear positioning pin is restricted.

However, in a case of considering realizing (1) a function of forming a gap between the photosensitive drum 12 and the LED print head, and (2) a function of restricting movement of the housing in the X direction and Y direction, as in Japanese Patent Laid-Open No. 2014-213541, but using not different pins but the same pins in common, the mechanism disclosed in Japanese Patent Laid-Open No. 2014-213541, where the lower ends of the pins are supported by the supporting portion, will be large in size.

SUMMARY OF THE INVENTION

An image forming apparatus according to the present invention has a drum unit rotatably supporting a photosensitive drum. The image forming apparatus includes: an optical print head configured to expose the photosensitive drum; a movement mechanism configured to reciprocally move the optical print head between an exposure position where the photosensitive drum is exposed, and a retracted position that is further retracted from the drum unit than the exposure position; a first abutting pin that is provided protruding from one end side of the optical print head in the longitudinal direction of the optical print head toward the drum unit side and the opposite side from the drum unit side, and that is configured to be abutted against a first abutted portion formed on one end side of the drum unit in the longitudinal direction to position the one end side of the optical print head in the longitudinal direction as to the drum unit; a second abutting pin that is provided protruding from an other end side of the optical print head in the longitudinal direction toward the drum unit side and the opposite side from the drum unit side, and that is configured to be abutted against a second abutted portion formed on the other end side of the drum unit in the longitudinal direction to position the other end side of the optical print head in the longitudinal direction as to the drum unit; and a facing portion that is provided facing both sides of the first abutting pin in the vertical direction, at the opposite side of the side to which the drum unit is disposed as to the print head, and that is configured to come into contact with the first abutting pin in the vertical direction, to restrict movement of the first abutting pin in a perpendicular direction perpendicular to both the longitudinal direction and the direction of reciprocal movement. The movement mechanism includes a first moving member that supports the optical print head from the opposite side from the side where the drum unit side is disposed as to the optical print head, at a position further toward the drum unit than, out of both ends of the first abutting pin in the direction of reciprocating movement, the end portion at the opposite side from the drum unit side, and reciprocally moves the optical print head, and a second moving member that supports the optical print head from the opposite side from the side where the drum unit is disposed as to the optical print head, at a position further toward the drum unit side than, out of both ends of the second abutting pin in the direction of reciprocating movement, the end portion at the opposite side from the drum unit side, and reciprocally moves the optical print head.

An image forming apparatus according to the present invention has a drum unit rotatably supporting a photosensitive drum. The image forming apparatus includes: an optical print head configured to expose the photosensitive drum; a movement mechanism configured to reciprocally move the optical print head between an exposure position where the photosensitive drum is exposed, and a retracted position that is further retracted from the drum unit than the exposure position; a first abutting pin that is formed protruding from one end side of the optical print head in the longitudinal direction of the optical print head toward the drum unit side and the opposite side from the drum unit side, and that is configured to be abutted against a first abutted portion formed on one end side of the drum unit in the longitudinal direction to position the one end side of the optical print head in the longitudinal direction as to the drum unit; a second abutting pin that is formed protruding from an other end side of the optical print head in the longitudinal direction toward the drum unit side and the opposite side from the drum unit side, and that is configured to be abutted against a second abutted portion formed on the other end side of the drum unit in the longitudinal direction to position the other end side of the optical print head in the longitudinal direction as to the drum unit; and a facing portion that is provided facing both sides of the second abutting pin in the vertical direction, at the opposite side of the side to which the drum unit is disposed as to the optical print head, and that is configured to come into contact with the second abutting pin in the vertical direction, to restrict movement of the second abutting pin in a perpendicular direction perpendicular to both the longitudinal direction and the direction of reciprocal movement. The movement mechanism includes a first moving member that supports the optical print head from the opposite side from the side where the drum unit is disposed as to the optical print head, at a position further toward the drum unit side than, out of both ends of the first abutting pin in the direction of reciprocating movement, the end portion at the opposite side from the drum unit side, and reciprocally moves the optical print head, and a second moving member that supports the optical print head from the opposite side from the side where the drum unit is disposed as to the optical print head, at a position further toward the drum unit side than, out of both ends of the second abutting pin in the direction of reciprocating movement, the end portion at the opposite side from the drum unit side, and reciprocally moves the optical print head.

Further features of the present invention will become apparent from the following description of exemplary embodiments with reference to the attached drawings.

BRIEF DESCRIPTION OF THE DRAWINGS

FIGS. 5A through 5C2 are schematic diagrams for describing a circuit board, LED chips, and lens array of an optical print head.

FIGS. 7A1 through 7B2 are diagrams illustrating a state where an optical print head is in contact with a drum unit, and a retracted state.

FIGS. 16A1 through 16B are diagrams for describing an X-type movement mechanism.

DESCRIPTION OF THE EMBODIMENTS

Embodiment

Image Forming Apparatus

Figure 1:
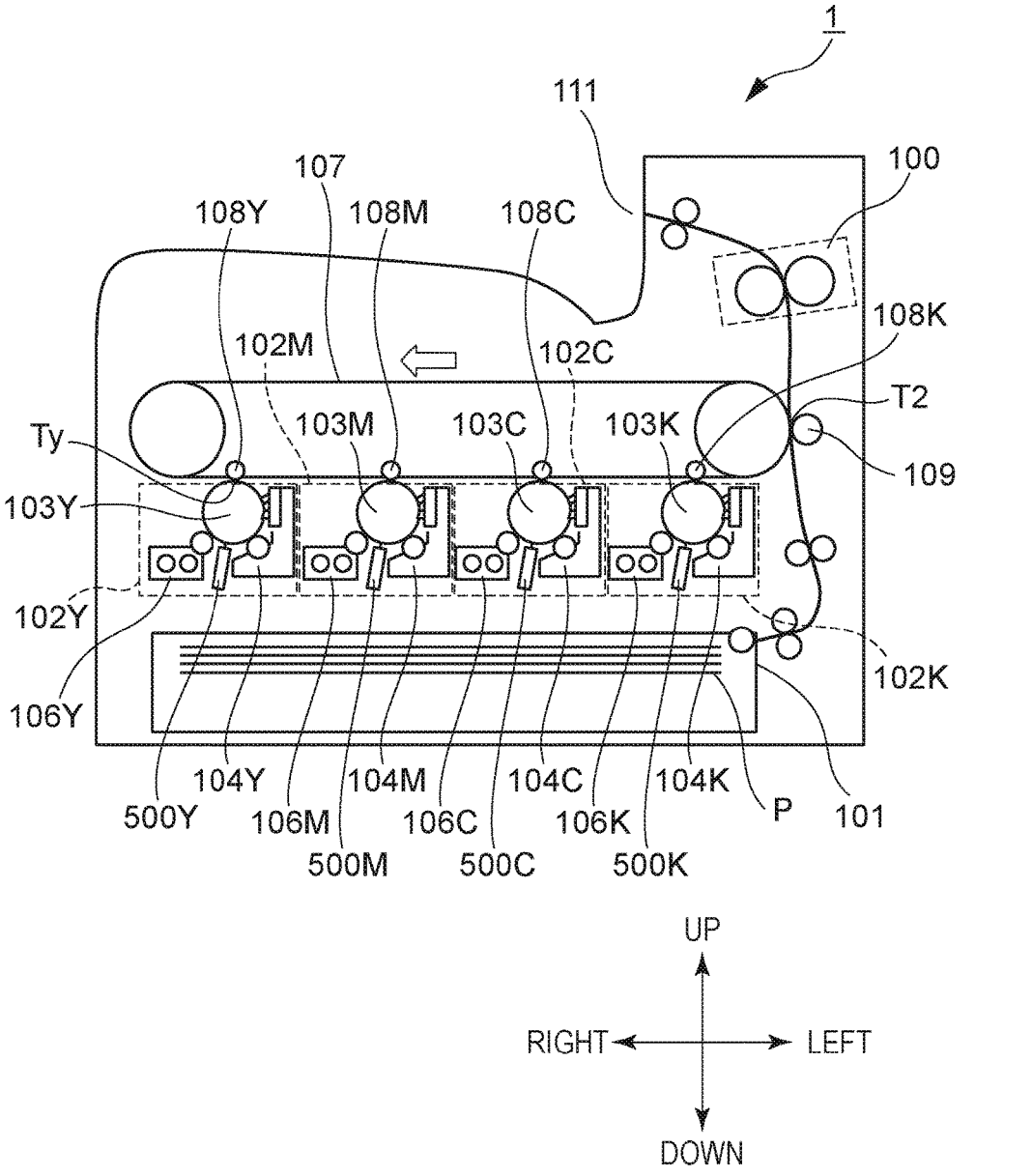
FIG. 1 is a schematic cross-sectional diagram of an image forming apparatus.

First, a schematic configuration of an image forming apparatus 1 will be described. FIG. 1 is a schematic cross-sectional view of the image forming apparatus 1. Although the image forming apparatus 1 illustrated in FIG. 1 is a color printer that does not have a reader, an embodiment may be a copying machine that has a reader. Also, an embodiment is not restricted to a color image forming apparatus having multiple photosensitive drums 103 as illustrated in FIG. 1, and may be a color image forming apparatus having one photosensitive drum 103 or an image forming apparatus that forms monochromatic images.

The image forming apparatus 1 illustrated in FIG. 1 has four image forming units 102Y, 102M, 102C, and 102K (hereinafter also collectively referred to simply as "image forming unit 102") that form toner images of the yellow, magenta, cyan, and black colors. The image forming units 102Y, 102M, 102C, and 102K respectively have a photosensitive drum 103Y, 103M, 103C, and 103K (hereinafter also collectively referred to simply as "photosensitive drum 103"). The image forming units 102Y, 102M, 102C, and 102K also respectively have a charger 104Y, 104M, 104C, and 104K (hereinafter also collectively referred to simply as "charger 104") for charging the photosensitive drums 103Y, 103M, 103C, and 103K. The image forming units 102Y, 102M, 102C, and 102K further respectively have a light-emitting diode (LED) exposing unit 500Y, 500M, 500C, and 500K (hereinafter also collectively referred to simply as "LED exposing unit 500") serving as an exposure light source that emits light to expose the photosensitive drums 103Y, 103M, 103C, and 103K. Moreover, the image forming units 102Y, 102M, 102C, and 102K respectively have a developing unit 106Y, 106M, 106C, and 106K (hereinafter also collectively referred to simply as "developing unit 106") that develops electrostatic latent images on the photosensitive drum 103 by toner, thereby developing toner images of the respective colors on the photosensitive drums 103. The Y, M, C, and K appended to the reference numerals indicate the color of the toner.

The image forming apparatus 1 is provided with an intermediate transfer belt 107 onto which toner images formed on the photosensitive drums 103 are transferred, and primary transfer roller 108 (Y, M, C, K) that sequentially transfer the toner images formed on the photosensitive drums 103 of the image forming units 102 onto the intermediate transfer belt 107. The image forming apparatus 1 further is provided with a secondary transfer roller 109 that transfers the toner image on the intermediate transfer belt 107 onto a recording sheet P conveyed from a sheet feed unit 101, and a fixing unit 100 that fixes the secondary-transferred image onto the recording sheet P.

Drum Unit

Figure 2A:
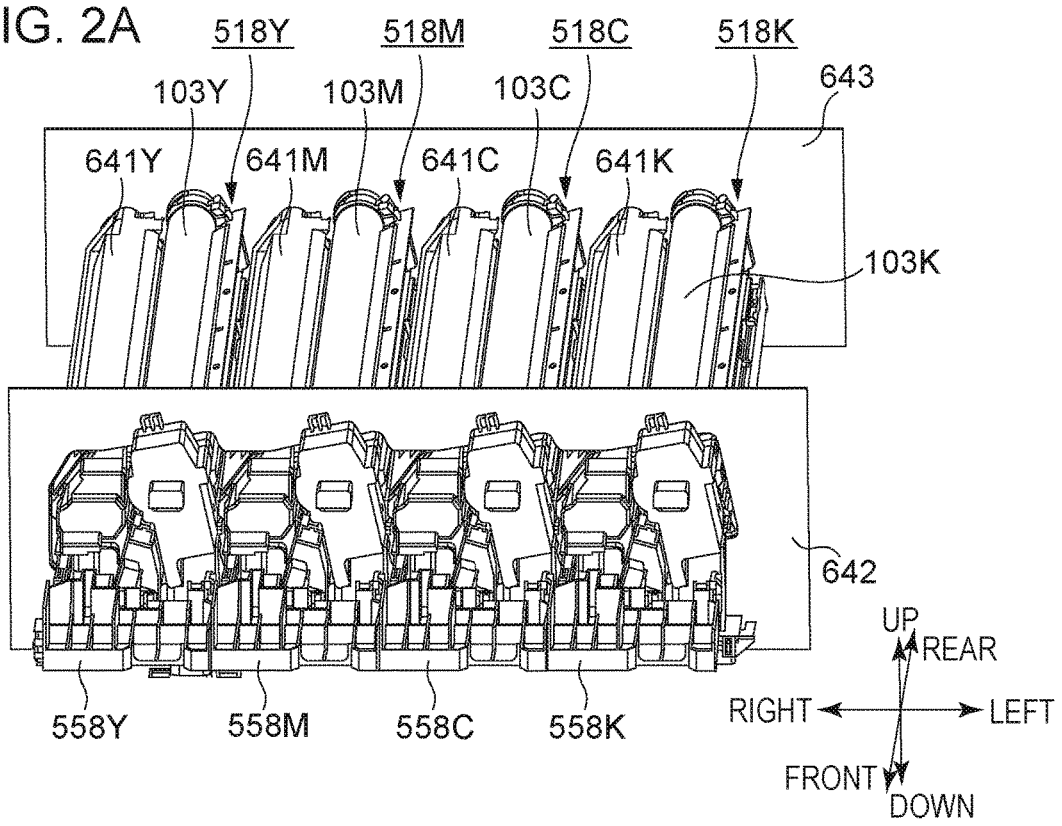
FIGS. 2A and 2B are perspective views of around drum units in the image forming apparatus.
Figure 2B:
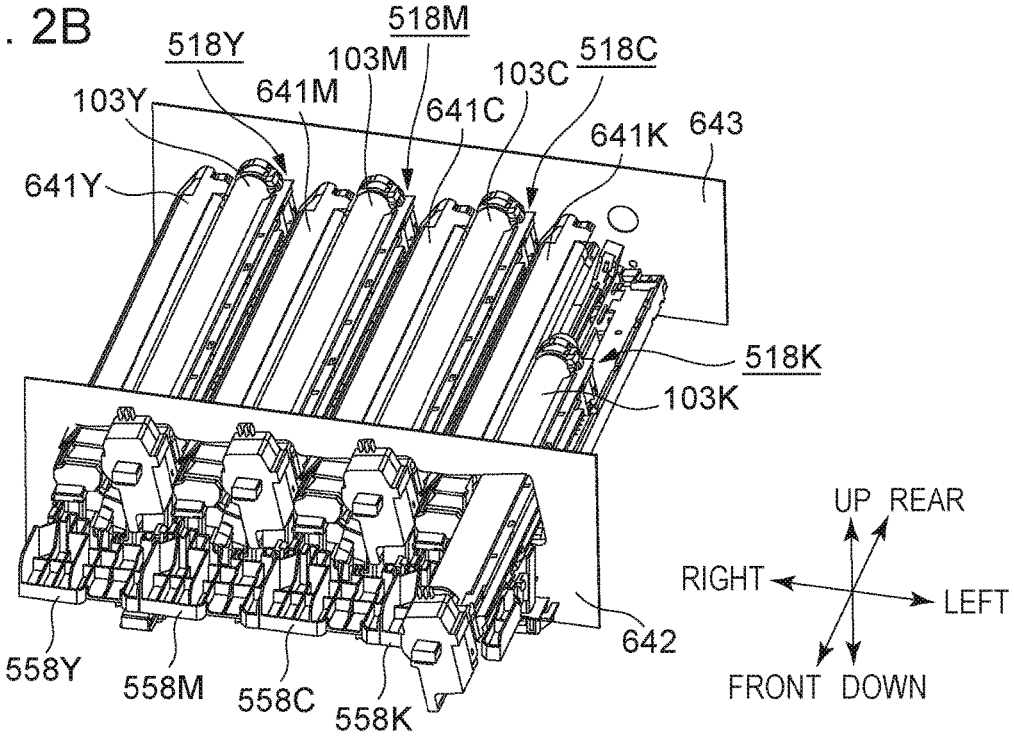

Next, drum units 518 (Y, M, C, K), and developing units 641 (Y, M, C, K), which are an example of replacement units detachably mounted to the image forming apparatus 1 according to the present embodiment, will be described. FIG. 2A is a schematic perspective view around the drum units 518 and developing units 641 that the image forming apparatus 1 has. FIG. 2B is a diagram illustrating a drum unit 518 in a state partially inserted into the image forming apparatus 1 from the outer side of the apparatus main body.

The image forming apparatus 1 has a front-side plate 642 and a rear-side plate 643 that are formed from sheet metal, as illustrated in FIG. 2A. The front-side plate 642 is a side wall provided to the front side of the image forming apparatus 1. The rear-side plate 643 is a side wall provided to the rear side of the image forming apparatus 1. The front-side plate 642 and rear-side plate 643 are disposed facing each other as illustrated in FIG. 2A, with sheet metal serving as beams that are omitted from illustration crossing therebetween. The front-side plate 642, rear-side plate 643, and unshown beams make up part of a frame of the image forming apparatus 1.

Openings are formed on the front-side plate 642, through which the drum units 518 and developing units 641 can be inserted and extracted from the front side of the image forming apparatus 1. The drum units 518 and developing units 641 are mounted through openings to predetermined positions in the main body of the image forming apparatus 1 (mounting positions). The image forming apparatus 1 also has covers 558 (Y, M, C, K) that cover the front side of the drum units 518 and developing units 641 mounted to the mounting positions. The covers 558 have one end thereof fixed integrally to the main body of the image forming apparatus 1 by a hinge, and are capable of pivoting as to the main body of the image forming apparatus 1 on the hinge. Unit replacement work is completed by a worker who performs maintenance opening a cover 558 and extracting a drum unit 518 or developing unit 641 within the main body, inserting a new drum unit 518 or developing unit 641, and closing the cover 558. The covers 558 will be described in detail later.

In the following description, the front-side plate 642 side of the image forming apparatus 1 is defined as the front side, and the rear-side plate 643 side as the rear side, as illustrated in FIGS. 2A and 2B. The side where the photosensitive drum 103Y that forms electrostatic latent images relating to yellow toner images is disposed is defined as the right side, with the photosensitive drum 103K that forms electrostatic latent images relating to black toner images as a reference. The side where the photosensitive drum 103K that forms electrostatic latent images relating to black toner images is disposed is defined as the left side, with the photosensitive drum 103Y that forms electrostatic latent images relating to yellow toner images as a reference. Further, a direction that is perpendicular to the front-and-rear directions and left-and-right directions defined here, and is upward in the vertical direction is defined as the upward direction, and a direction that is perpendicular to the front-and-rear directions and left-and-right directions defined here, and is downward in the vertical direction is defined as the downward direction. The defined front direction, rear direction, right direction, left direction, upward direction, and downward direction, are illustrated in FIGS. 2A and 2B. The term "one end side of the photosensitive drum 103 in the rotational axis direction" (one end side of the holding member 505 in the longitudinal direction of the holding member 505) as used in the present specification means the front side as defined here, and "other end side" means the rear side as defined here. The one end side and other end side in the front-and-rear direction here also correspond to the front side and rear side defined here. The one side in the left-and-right direction means the right side as defined here, and the other end side means the left side as defined here.

Drum units 518 are attached to the image forming apparatus 1 according to the present embodiment. The drum units 518 are cartridges that are replaced. The drum units 518 according to the present embodiment have photosensitive drums 103 rotatably supported as to the casing of the drum units 518. The drum units 518 each have a photosensitive drum 103, charger 104, and cleaning device that is omitted from illustration. When the lifespan of a photosensitive drum 103 is expended due to wear by cleaning by the cleaning device for example, a worker who performs maintenance extracts the drum unit 518 from the apparatus main body, and replaces the photosensitive drum 103, as illustrated in FIG. 2B. Note that a configuration may be made where the drum unit 518 includes neither the charger 104 nor cleaning device, and only includes the photosensitive drum 103.

The developing units 641, which are separate from the drum units 518, are attached to the image forming apparatus 1 according to the present embodiment. The developing units 641 include the developing units 106 illustrated in FIG. 1. Each developing unit 106 is provided with a developing sleeve serving as a developing agent bearing member that bears a developing agent. Each developing unit 641 is provided with multiple gears for rotating a screw that agitates the toner and a carrier. When these gears deteriorate due to age or the like, a worker performing maintenance extracts the developing unit 641 from the apparatus main body of the image forming apparatus 1 and replaces it. The developing unit 641 according to the present embodiment is a cartridge where a developing unit 106 having a developing sleeve, and a toner container in which a screw is provided, have been integrated. An embodiment of the drum unit 518 and developing unit 641 may be a process cartridge where the drum unit 518 and developing unit 641 are integrated.

Image Forming Process

Next, an image forming process will be described. A later-described optical print head 105Y exposes the surface of the photosensitive drum 103Y that has been charged by the charger 104Y. Accordingly, an electrostatic latent image is formed on the photosensitive drum 103Y. Next, the developing unit 106Y develops the electrostatic latent image formed on the photosensitive drum 103Y by yellow toner. The yellow toner image developed on the surface of the photosensitive drum 103Y is transferred onto the intermediate transfer belt 107 by the primary transfer roller 108Y at a primary transfer position Ty. Magenta, cyan, and black toner images are also transferred onto the intermediate transfer belt 107 by the same image forming process.

The toner images of each color transferred onto the intermediate transfer belt 107 are conveyed to a secondary transfer position T2 by the intermediate transfer belt 107. Transfer bias for transferring the toner images onto a recording sheet P is applied to the secondary transfer roller 109 disposed at the secondary transfer position T2. The toner images conveyed to the secondary transfer position T2 are transferred onto a recording sheet P conveyed from the sheet feed unit 101 by the transfer bias of the secondary transfer roller 109. The recording sheet P onto which the toner images have been transferred is conveyed to the fixing unit 100. The fixing unit 100 fixes the toner images onto the recording sheet P by heat and pressure. The recording sheet P subjected to fixing processing by the fixing unit 100 is discharged to a sheet discharge unit 111.

Exposing Unit

Figure 3:
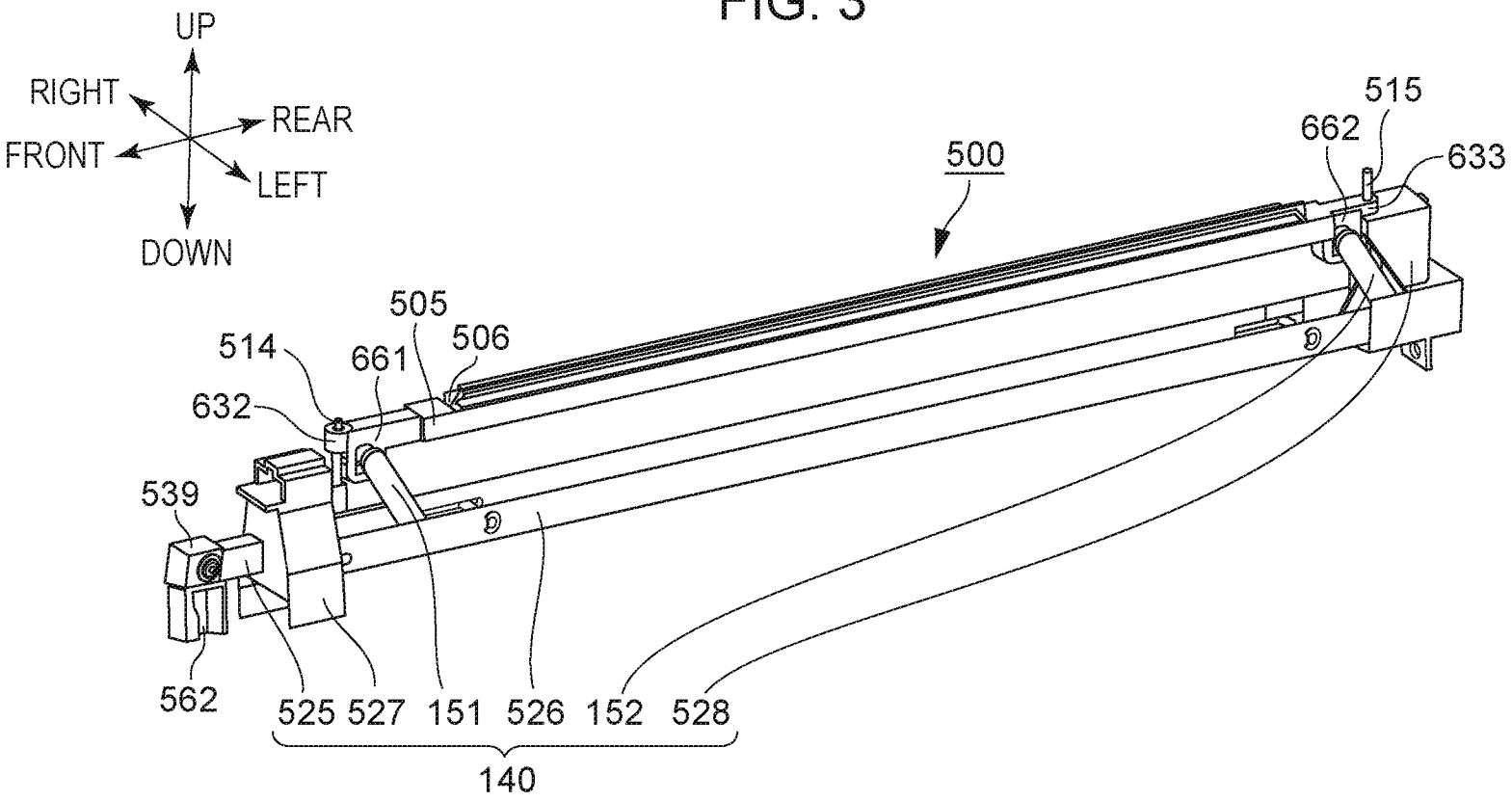
FIG. 3 is a schematic perspective view of an exposing unit.
Figure 4:
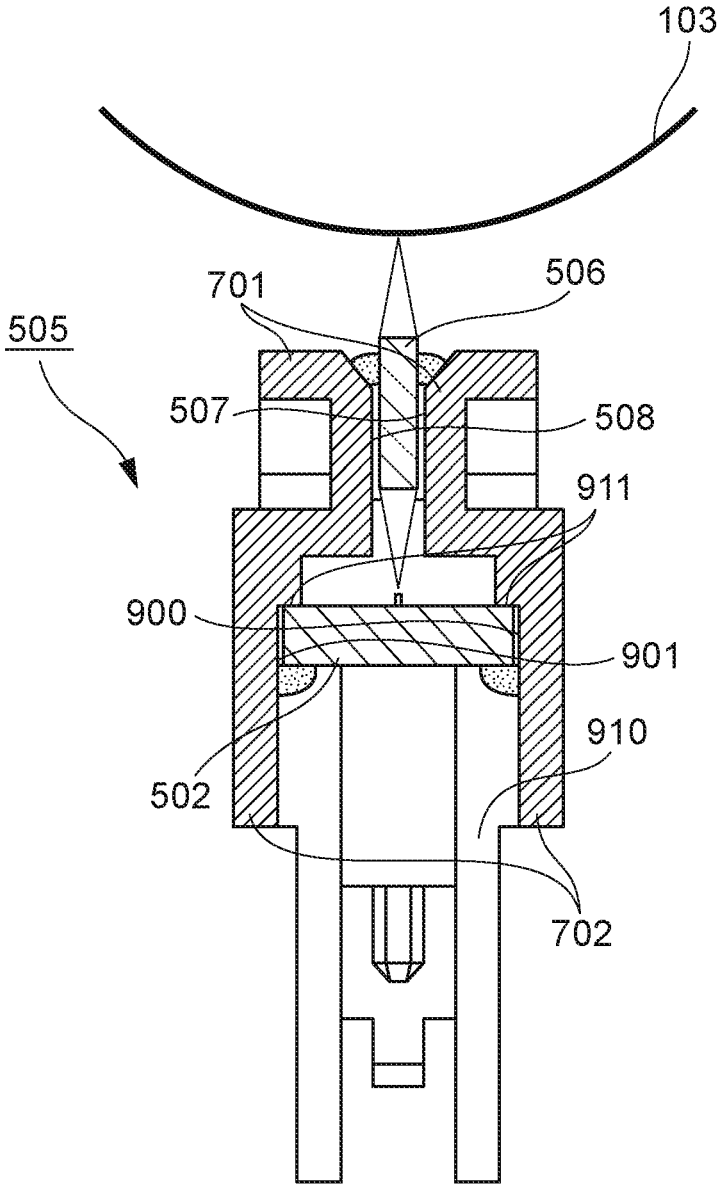
FIG. 4 is a cross-sectional view of an optical print head, taken along a direction perpendicular to a rotational axis of a photosensitive drum.

The exposing unit 500 including the optical print head 105 will be described next. Laser beam scanning exposure, where an emitted semiconductor laser beam is scanned using a rotating polygon mirror or the like and the photosensitive drum is exposed via an F-theta lens or the like is known as one example of an exposing method employed in electrophotographic image forming apparatuses. The "optical print head 105" described in the present embodiment is used in LED exposure where light-emitting elements such as LEDs or the like arrayed following the rotational axis direction of the photosensitive drum 103 are used to expose the photosensitive drum 103, but is not used in the above-described laser beam scanning exposure. FIG. 3 is a schematic perspective view of the exposing unit 500 that the image forming apparatus 1 according to the present embodiment has. FIG. 4 is a schematic cross-sectional diagram where the exposing unit 500 illustrated in FIG. 3, and the photosensitive drum 103 disposed to the upper side of the exposing unit 500, have been cut away on a plane perpendicular to the rotational axis direction of the photosensitive drum 103. The exposing unit 500 has the optical print head 105 and a movement mechanism 140.

The optical print head 105 is provided with a holding member 505 that holds a lens array 506 (lenses) and circuit board 502, an abutting pin 514 (first abutting pin), and an abutting pin 515 (second abutting pin). The movement mechanism 140 has a link mechanism 151 that is an example of a first moving member, a second link mechanism 152 that is an example of a second moving member, a sliding portion 525, a first support portion 527, a second support portion 528, and a third support portion 526. Although the abutting pin 514 and abutting pin 515 are described as being cylindrical pins in the present embodiment, the shape thereof is not restricted to being cylindrical, and may be polygonal posts, or conical shapes where the diameter is tapered toward the tip.

First, the holding member 505 will be described. The holding member 505 is a holder that holds the later-described circuit board 502, lens array 506, abutting pin 514, and abutting pin 515. The holding member 505 is provided with lens attaching portions 701 where the lens array 506 is attached, and circuit board attaching portions 702 where the circuit board 502 is attached, as illustrated in FIG. 4. The holding member 505 also has spring attaching portion 661, spring attaching portion 662, pin attaching portion 632, and pin attaching portion 633, which will be described later with reference to FIGS. 23A through 23D. The holding member 505 according to the present embodiment has the lens attaching portion 701, circuit board attaching portion 702, spring attaching portion 661, spring attaching portion 662, pin attaching portion 632, and pin attaching portion 633. The holding member 505 is a molded resin article, where the lens attaching portion 701, circuit board attaching portion 702, spring attaching portion 661, and spring attaching portion 662, have been integrally formed by injection molding. Note that the material of the holding member 505 is not restricted to resin, and may be metal or the like, for example.

The spring attaching portion 661 to which the link member 151 is attached is provided between the lens array 506 and the pin attaching portion 632 in the front-and-rear direction, as illustrated in FIG. 3. Also, the spring attaching portion 662 to which the link member 152 is attached is provided between the lens array 506 and the pin attaching portion 633 in the front-and-rear direction. That is to say, the holding member 505 is supported by the link member 151 between the lens array 506 and abutting pin 514 in the front-and-rear direction, and is supported by the link member 152 between the lens array 506 and abutting pin 515 in the front-and-rear direction, when the optical print head 105 moves between the exposure position and the retracted position. In other words, the link member 151 (first moving member) supports the holding member 505 further downstream in the longitudinal direction heading from the other end side of the holding member 505 toward the one end side than the lens array 506. The link member 152 (second moving member) supports the holding member 505 further downstream in the longitudinal direction heading from the one end side of the holding member 505 toward the other end side than the lens array 506. Portions where biasing force is applied to the holding member 505 by the link member 151 and link member 152 do not overlap the lens array 506 in the vertical direction, so warping of the lens array 506 due to this biasing force is reduced.

The lens attaching portion 701 has a first inner wall face 507 that extends in the longitudinal direction of the holding member 505, and a second inner wall face 508 that faces the first inner wall face 507 and also extends in the longitudinal direction of the holding member 505. The lens array 506 is inserted between the first inner wall face 507 and the second inner wall face 508 when assembling the optical print head 105. Adhesive agent is coated between the side face of the lens array 506 and the lens attaching portion 701, thereby fixing the lens array 506 to the holding member 505.

The circuit board attaching portion 702 has a cross-sectional open-box shape, and has a third inner wall face 900 extending in the longitudinal direction of the holding member 505, and a fourth inner wall face 901 that faces the third inner wall face 900 and extends in the longitudinal direction of the holding member 505, as illustrated in FIG. 4. A gap 910 into which the circuit board 502 is inserted is formed between the third inner wall face 900 and fourth inner wall face 901. The circuit board attaching portion 702 also includes circuit board abutting portions 911 where the circuit board 502 abuts. The circuit board 502 is inserted from the gap 910 when assembling the optical print head 105, and pressed as far as the circuit board abutting portions 911. Adhesive agent is coated on the boundary portion between the gap 910 side of the circuit board 502 and the third inner wall face 900 and fourth inner wall face 901 in a state where the circuit board 502 is abutted against the circuit board abutting portions 911, thereby fixing the circuit board 502 to the holding member 505.

The exposing unit 500 is disposed on the lower side in the vertical direction from the rotational axis of the photosensitive drum 103, and LEDs 503 that the optical print head 105 has expose the photosensitive drum 103 from below. Note that an arrangement may be made where the exposing unit 500 is provided to the upper side in the vertical direction from the rotational axis of the photosensitive drum 103, with LEDs 503 of the optical print head 105 exposing the photosensitive drum 103 from above.

Next, the circuit board 502 held by the holding member 505 will be described. FIG. 5A is a schematic perspective diagram of the circuit board 502. FIG. 5B1 illustrates an array of multiple LEDs 503 provided to the circuit board 502, and FIG. 5B2 is an enlarged view of FIG. 5B1.

LED chips 639 are mounted on the circuit board 502. The LED chips 639 are mounted on one face of the circuit board 502, while a connector 504 is provided to the rear face side, as illustrated in FIG. 5A. The circuit board 502 is provided with wiring to supply signals to the LED chip 639. One end of a flexible flat cable (FFC) that is omitted from illustration is connected to the connector 504. A circuit board is provided to the main body of the image forming apparatus 1. The circuit board has a control unit and connector. The other end of the FFC is connected to this connector. Control signals are input to the circuit board 502 from the control unit of the main body of the image forming apparatus 1 via the FFC and connector 504. The LED chips 639 are driven by the control signals input to the circuit board 502.

The LED chips 639 mounted on the circuit board 502 will be described in further detail. Multiple (29) LED chips 639-1 through 639-29, on which multiple LEDs 503 are arrayed, are arrayed on one face of the circuit board 502, as illustrated in FIGS. 5B1 and 5B2. Each of the LED chips 639-1 through 639-29 has 516 LEDs (light-emitting elements) arrayed in a single row in the longitudinal direction thereof. The center-to-center distance k2 between LEDs adjacent in the longitudinal direction in the LED chips 639 corresponds to the resolution of the image forming apparatus 1. The resolution of the image forming apparatus 1 according to the present embodiment is 1200 dpi, so the LEDs are arrayed in a single row so that the center-to-center distance k2 between adjacent LEDs in the longitudinal direction of the LED chips 639-1 through 639-29 is 21.16 μm. Accordingly, the range of exposure of the optical print head 105 according to the present embodiment is 316 mm. The photosensitive layer of the photosensitive drum 103 is formed 316 mm or wider. The long side of an A4-size recording sheet and the short side of an A3-size recording sheet are 297 mm, so the optical print head 105 according to the present embodiment has an exposing range capable of forming images on A4-size recording sheets and A3-size recording sheets.

The LED chips 639-1 through 639-29 are alternately arrayed to form two rows in the rotational axis direction of the photosensitive drum 103. That is to say, odd-numbered LED chips 639-1, 639-3, and so on through 639-29, are arrayed on one line in the longitudinal direction of the circuit board 502 from the left, and even-numbered LED chips 639-2, 639-4, and so on through 639-28, are arrayed on one line in the longitudinal direction of the circuit board 502, as illustrated in FIG. 5B1. Arraying the LED chips 639 in this way enables the center-to-center distance k1 between the LEDs disposed on one end of one LED chip 639 and the other end of another LED chip 639 among different adjacent LED chips 639 to be equal to the center-to-center distance k2 of adjacent LEDs on the same LED chip 639, in the longitudinal direction of the LED chips 639, as illustrated in FIG. 5B2.

An example where the exposing light source is configured using LEDs is described in the present embodiment. However, organic electroluminescence (EL) devices may be used instead for the exposing light source.

Next, the lens array 506 will be described. FIG. 5C1 is a schematic diagram viewing the lens array 506 from the photosensitive drum 103 side. FIG. 5C2 is a schematic perspective view of the lens array 506. These multiple lenses are arrayed in two rows following the direction of array of the multiple LEDs 503, as illustrated in FIG. 5C1. The lenses are disposed in a staggered manner such that each lens in one row comes into contact with two lenses in the other row that are adjacent in the direction of array of the lenses. The lenses are cylindrical glass rod lenses. Note that the material of the lenses is not restricted to glass, and that plastic may be used. The shape of the lenses is not restricted to a cylindrical shape either, and may be polygonal posts such as hexagonal posts or the like, for example.

A dotted line Z in FIG. 5C2 indicates the optical axis of a lens. The optical print head 105 is moved by the above-described movement mechanism 140 in a direction generally following the optical axis of the lens indicated by the dotted line Z. The term optical axis here means a line that connects the center of the light emitting face of the lens and the focal point of this lens. The discharged light emitted from an LED enters a lens included in the lens array 506, as illustrated in FIG. 4. The lens functions to condense the discharged light entering the lens onto the surface of the photosensitive drum 103. The attachment position of the lens array 506 as to the lens attaching portion 701 is adjusted when assembling the optical print head 105, such that the distance between the light-emitting face of the LED and incoming light face of the lens, and the distance between the light-emitting face of the lens and the surface of the photosensitive drum 103, are generally equal.

Figure 6A:
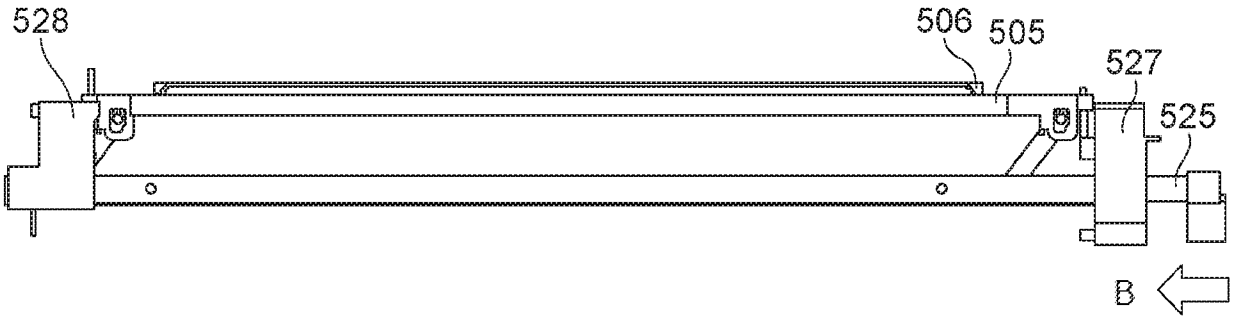
FIGS. 6A and 6B are side views of an optical print head.
Figure 6B:
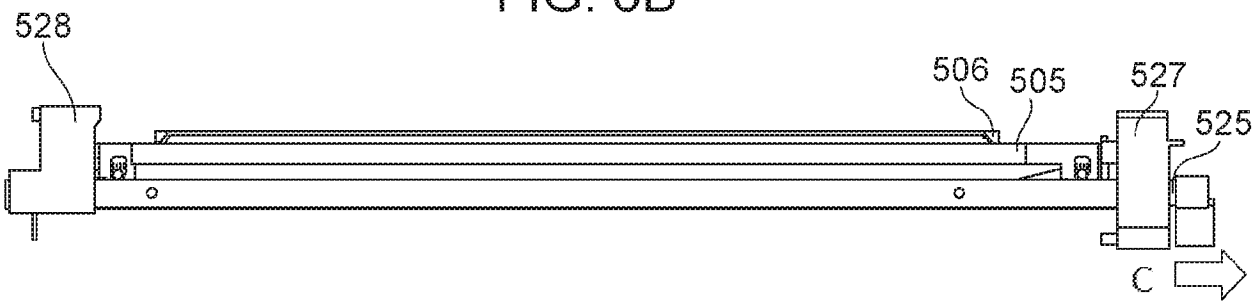

Now, the necessity of moving the optical print head 105 will be described. When replacing a drum unit 518 in the image forming apparatus 1 according to the present embodiment, the drum unit 518 is moved by sliding in the rotational axis direction of the photosensitive drum 103 to the front side of the apparatus main body, as illustrated in FIG. 2B. Moving the drum unit 518 in a state where the optical print head 105 is situated near the surface of the photosensitive drum 103 results in the drum unit 518 coming into contact with the surface of the photosensitive drum 103 while moving by sliding, and the surface of the photosensitive drum 103 being mounted will be scratched. Also, the lens array 506 will come into contact with the frame of the drum unit 518 and the lens array 506 will be scratched. Accordingly, a structure is necessary where the optical print head 105 is reciprocally moved between an exposure position (FIG. 6A) where the photosensitive drum 103 is exposed, and a retracted position (FIG. 6B) retracted from the exposure position. When the sliding portion 525 moves by sliding in the direction of arrow B with the optical print head 105 at the exposure position (FIG. 6A), the optical print head 105 moves in a direction toward the retracted position (FIG. 6B). On the other hand, when the sliding portion 525 moves by sliding in the direction of arrow C with the optical print head 105 at the retracted position (FIG. 6A), the optical print head 105 moves in a direction toward the exposure position (FIG. 6A). This will be described in detail later.

FIG. 7A1 is a perspective view illustrating a bushing 671 provided to the rear side of the optical print head 105 situated in the exposure position and the rear side of the drum unit 518. FIG. 7A2 is a cross-sectional view illustrating the second support portion 528 and the bushing 671 provided to the rear side of the drum unit 518 when the optical print head 105 situated in the exposure position. FIG. 7B1 is a perspective view illustrating the bushing 671 provided to the rear side of the optical print head 105 situated in the retracted position and the rear side of the drum unit 518. FIG. 7B2 is a cross-sectional view illustrating the second support portion 528 and the bushing 671 provided to the rear side of the drum unit 518 when the optical print head 105 is in the retracted position.

Now, the positioning pins disclosed in Japanese Patent Laid-Open No. 2014-213541 will be described with comparison to the abutting pin 515 (514) described in the present embodiment, with reference to FIGS. 7A1 through 7B2. Note that the reference symbols used in Japanese Patent Laid-Open No. 2014-213541 will be used to describe the parts disclosed in Japanese Patent Laid-Open No. 2014-213541.

In Japanese Patent Laid-Open No. 2014-213541, two each of positioning pins (first front positioning pin and second front positioning pin, first rear positioning pin and second rear positioning pin) are disposed at both end sides of the housing in a longitudinal direction of the housing, to relatively position the LED print head and the photosensitive drum. However, providing two positioning pins each at both end sides of the housing in the X direction has problems such as (1) the length of the housing 61 in the longitudinal direction of the housing being longer, and (2) using multiple positioning pins increases costs.

Accordingly, in the present embodiment, the number of positioning pins to be provided to the holding member 505 is one each at both end sides in the X direction (abutting pin 514 and abutting pin 515), with individual pins having both a function of forming a gap between the optical print head 105 and photosensitive drum 103, and a function of restricting movement of the holding member 505 in the X direction and Y direction. Accordingly, the positioning pins (abutting pin 514 and abutting pin 515) protrude from both the upper and lower directions of the holding member 505. That is to say, these positioning pins (abutting pin 514 and abutting pin 515) are formed protruding from the abutting pin 515 to the drum unit 518 side, and to the opposite side from the drum unit 518 side, in the vertical direction. Japanese Patent Laid-Open No. 2014-213541 describes a structure where the supporting member abuts the lower ends of the first front positioning pin and first rear positioning pin. However, supporting the pins protruding from the lower side of the holding member 505 in a structure such as in the present embodiment where the restricting portion 128 has been provided below the holding member 505 leads to increased size of the apparatus in the vertical direction.

The way in which the end portion of the abutting pin 515 at the drum unit 518 side abuts the bushing 671 will be described with reference to FIGS. 7A1 through 7B2. A part equivalent to the bushing 671 is provided on the front side of the drum unit 518, and the structure and function thereof are the same as with the bushing 671. The drum unit 518 side end portion of the abutting pin 514 abuts this part. The way in which the drum unit 518 side end portion of the abutting pin 515 comes into contact with the bushing 671 will be described here.

It can be seen from FIGS. 7A1 and 7B1 that the portion where the link member 152 serving as the second moving member is attached to the holding member 505 is closer to the photosensitive drum 103 side from the one of the ends of the second abutting pin 515 that is opposite to the replacement unit side (the side where the drum unit 518 is disposed), in the vertical direction (the direction in which the optical print head 105 moves between the exposure position and the retracted position, i.e., in the direction of reciprocal movement). The spring attaching position 662 to which the link member 152 is attached is disposed so as to not intersect the second abutting pin 515 in the vertical direction. The portion where the link member 151 serving as the first moving member is attached to the holding member 505 also is closer to the photosensitive drum 103 side from the one of the ends of the abutting pin 515 that is opposite to the replacement unit side (the side where the drum unit 518 is disposed) out of the ends of the first abutting pin 514 in the vertical direction (the direction in which the optical print head 105 moves between the exposure position and the retracted position, i.e., in the direction of reciprocal movement), although omitted from illustration here. The spring attaching portion 661 where the link member 151 is attached is disposed so as to not intersect the first abutting pin 514 in the vertical direction. Accordingly, the size of the exposing unit 500 in the vertical direction can be suppressed.

The second support portion 528 (example of a guide portion) has an abutting face 587, the restricting portion 128 that is an example of a facing portion, a first wall face 588, and a second wall face 589, as illustrated in FIGS. 7A2 and 7B2. The abutting face 587 is provided to the lower side of the holding member 505. The lower side of the holding member 505 moving from the exposure position toward the retracted position abuts the abutting face 587 and also the abutting face 586 of the later-described first support portion 527, and thus the optical print head 105 is at the retracted position.

The restricting portion 128 is a recess formed in the second support portion 528 and having the shape of a box with one side open, being opened toward the front side. The restricting portion 128 is formed to the opposite side of the holding member 505 from the side where the drum unit 518 is situated. The restricting portion 128 is situated further in the downstream side than the abutting pin 515 in the direction of heading from one end side of the holding member 505 in the longitudinal direction of the holding member 505 toward the other end side (direction from front side toward rear side). The restricting portion 128 is formed from the rear side of the abutting pin 515 toward the abutting pin 515, and has a gap that intersects the abutting pin 515 in a direction perpendicular (perpendicular direction) to both the longitudinal direction of the holding member 505 and the reciprocal movement direction (the direction of the holding member 505 moving between the exposure position and retracted position. The abutting pin 515 protruding from the lower side of the holding member 505 fits into the gap formed by the restricting portion 128, and vertically moves along with the holding member 505 while moving through this gap. A state where the abutting pin 515 and the restricting portion 128 are fit as used here means a state of fitting with where the difference between the width of the gap formed by the restricting portion 128 in the left-and-right direction and the width of the portion of the abutting pin 515 moving through the restricting portion 128 in the left-and-right direction is 10 μm or more but 30 μm or less.

The first support portion 527 also has a restricting portion 127 (example of a facing portion), though omitted from illustration here. The restricting portion 127 is a recess formed in the first support portion 527 and having the shape of a box with one side open, being opened toward the front side. The restricting portion 127 is formed to the opposite side of the holding member 505 from the side where the drum unit 518 is situated. The restricting portion 127 is situated further in the downstream side than the abutting pin 514 in the direction of heading from the other end side of the holding member 505 in the longitudinal direction of the holding member 505 toward the one end side (direction from rear side toward front side). The restricting portion 127 is formed from the front side of the abutting pin 514 toward the abutting pin 514, and has a gap that intersects the abutting pin 514 in a direction perpendicular (perpendicular direction) to both the longitudinal direction of the holding member 505 and the reciprocal movement direction (the direction of the holding member 505 moving between the exposure position and retracted position. The abutting pin 514 protruding from the lower side of the holding member 505 fits the gap formed by the restricting portion 127. The abutting pin 515 vertically moves along with the holding member 505 while moving through this gap. Accordingly, movement of the holding member 505 that is integral with the abutting pin 515 and abutting pin 514 is restricted in the direction perpendicular (perpendicular direction) to both the directions intersecting both the front-and-rear direction (longitudinal direction of the holding member 505) and the vertical direction (the direction in which the holding member 505 moves between the exposure position and the retracted position). The restricting portion 127 may restrict the abutting pin 514 from moving from the rear side to the front side, and the restricting portion 128 may restrict the abutting pin 515 from moving from the front side to the rear side.

Figure 9A:
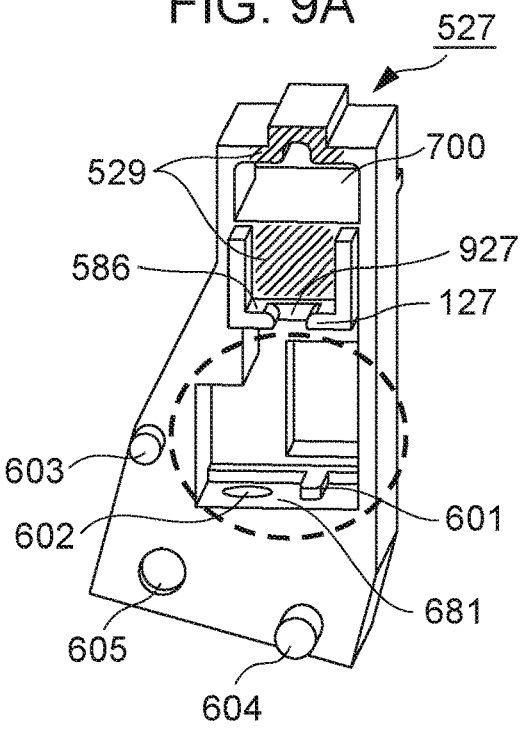
FIGS. 9A through 9C are perspective views of a first support portion and a third support portion.
Figure 9B:
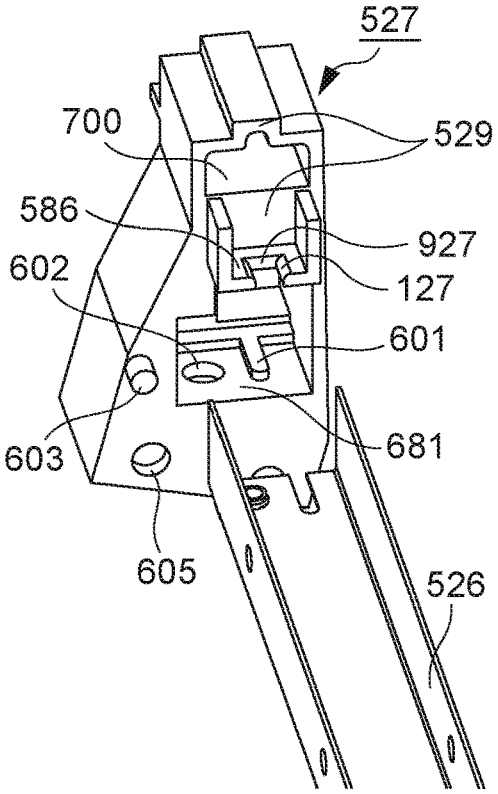
Figure 9C:
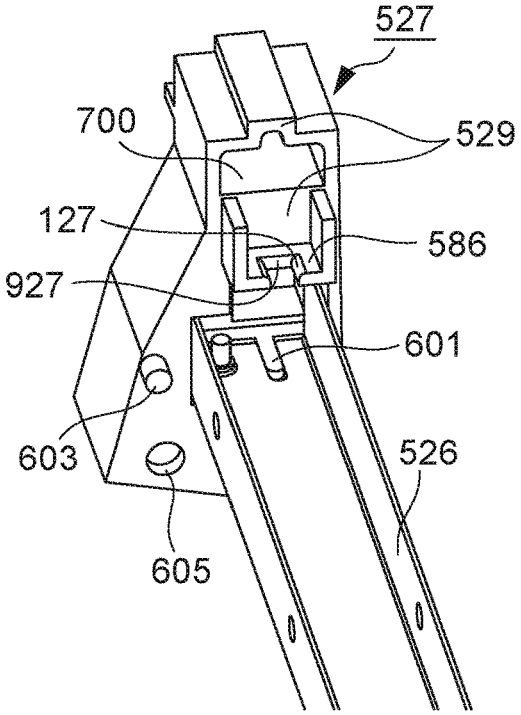
Figure 10A:
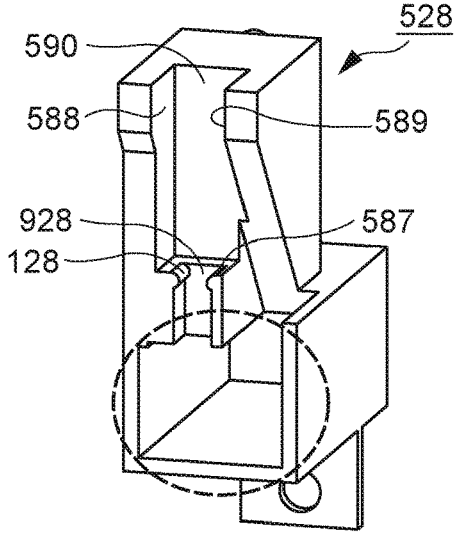
FIGS. 10A through 10C are perspective views of a second support portion, a rear-side plate, and an exposing unit attached to the second support portion.
Figure 10B:
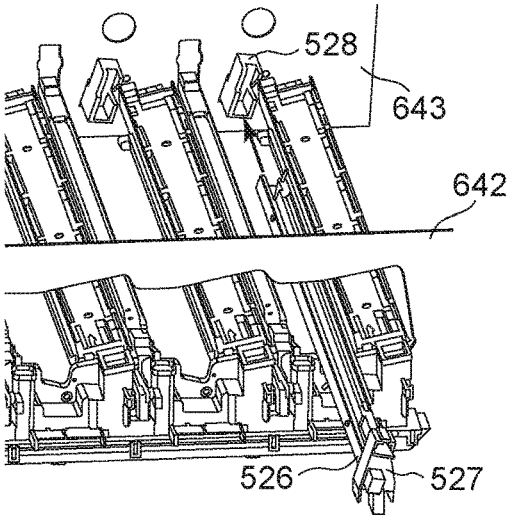
Figure 10C:
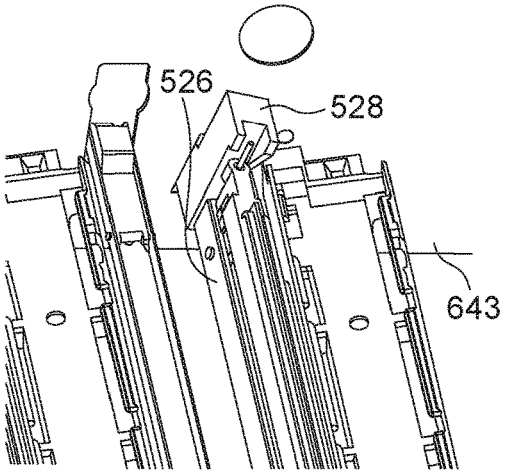

A facing face 927 is provided to the restricting portion 127, as illustrated in FIGS. 9A through 9C. The facing face 927 is a face that faces the holding member 505 in the front-and-back direction. This facing face 927 restricts the abutting pin 514 from moving from the rear side to the front side. Also, a facing face 928 is provided to the restricting portion 128, as illustrated in FIGS. 10A through 10C. The facing face 928 is a face that faces the holding member 505 in the front-and-back direction. This facing face 928 restricts the abutting pin 515 from moving from the front side to the rear side.

The first wall face 588 and second wall face 589 are disposed at positions facing each other in the left-and-right direction, with a gap formed. When the optical print head 105 reciprocally moves between the exposure position and the retracted position, the holding member 505 moves vertically through the gap formed by the first wall face 588 and second wall face 589. During this time, movement of the holding member 505 is restricted in the direction perpendicular to (perpendicular direction) both the front-and-rear direction (longitudinal direction of the holding member 505) and the vertical direction (the direction in which the optical print head 105 moves between the exposure position and the retracted position, i.e., in the direction of reciprocal movement), by the first wall face 588 and second wall face 589. A state where the holding member 505 is fit to a gap formed by the first wall face 588 and second wall face 589 is a state of fitting a gap where the difference between the width of the gap in the left-and-right direction and the width at the rear side of the holding member 505 in the left-and-right direction is 0.5 mm or more but 2 mm or less.

According to the above configuration, the optical print head 105 moves between the exposure position and retracted position in a state where movement is restricted in the direction perpendicular to (perpendicular direction) both the front-and-rear direction (longitudinal direction of the holding member 505) and the vertical direction (the direction in which the holding member 505 moves between the exposure position and the retracted position, i.e., in the direction of reciprocal movement). Note that it is sufficient for at least one of the restricting portion 127 (example of a facing portion) and restricting portion 128 (example of a facing portion) to be provided to the first support portion 527 or second support portion 528. That is to say, it is sufficient for the restricting portion 127 to be provided to the first support portion 527 that is an example of a support portion, or the restricting portion 128 to be provided to the second support portion 528.

The position at which the abutting pin 515 comes into contact with the bushing 671 provided to the rear side of the drum unit 518, and the abutting pin 514 (omitted from illustration) comes into contact with the part equivalent to the bushing 671 that is provided to the front side of the drum unit 518, is the exposure position of the optical print head 105, as illustrated in FIGS. 7A1 and 7A2. The distance between the lens array 506 and the surface of the photosensitive drum 103 becomes the designed nominal distance by the abutting pin 514 and the abutting pin 515 abutting the bushing 671 and the part equivalent to the bushing 671.

Note that the holding member 505 that has moved to the exposure position is situated further toward the drum unit 518 side than the gap formed by the first wall face 588 and second wall face 589. That is to say, movement of the holding member 505 at the exposure position in the perpendicular direction (direction perpendicular to both the longitudinal direction of the holding member 505 and the direction in which the holding member 505 moves between the exposure position and the retracted position) is not restricted by the first wall face 588 and second wall face 589.

On the other hand, the position where the abutting pin 515 is retracted from the bushing 671 provided to the rear side of the drum unit 518, as illustrated in FIGS. 7B1 and 7B2 is equivalent to the retracted position of the optical print head 105. The optical print head 105 is in a state where the drum unit 518 that moves by sliding for being replaced and the optical print head 105 do not come into contact, by the optical print head 105 being at the retracted position illustrated in FIGS. 7B1 and 7B2.

Figure 8:
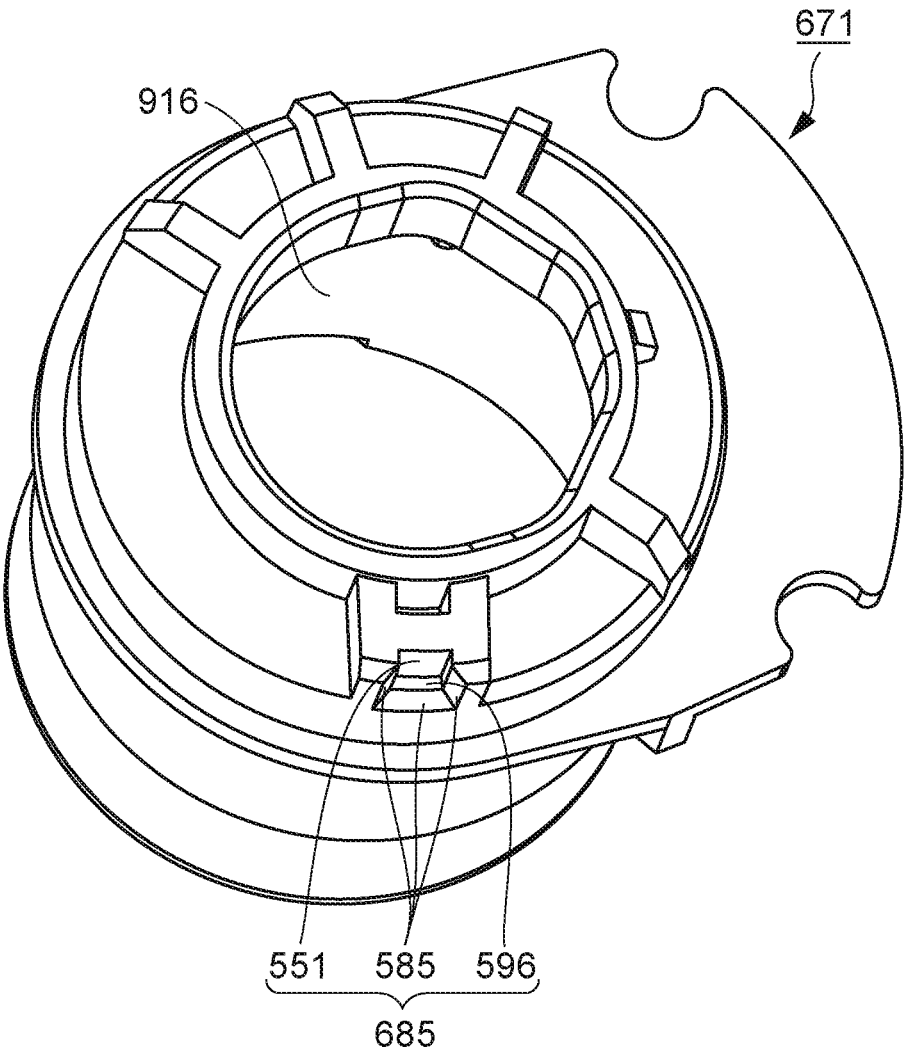
FIG. 8 is a perspective view of a bushing attached to the rear side of a drum unit.

Now, the bushing 671 that the drum unit 518 has will be described. FIG. 8 illustrates a perspective view of the bushing 671. The bushing 671 is a member fixed to the casing of the drum unit 518 by screws or adhesive agent. An opening 916 is formed in the bushing 671, as illustrated in FIG. 8. A shaft member at the other end side of the photosensitive drum 103 is rotatably inserted into the opening 916. That is to say, the bushing 671 rotatably bears the photosensitive drum 103.

The photosensitive drum 103 has a photosensitive layer formed on an outer face of a hollow cylindrical aluminum tube. Flanges 673 are press-fitted top both ends of the aluminum tube. The flange 673 at the other end side of the photosensitive drum 103 is rotatably inserted into the opening 916 formed in the bushing 671. The flange 673 rotates while rubbing against the inner wall face of the opening 916 formed in the bushing 671. That is to say, the bushing 671 rotatably bears the photosensitive drum 103. An opening the same as that of the bushing 671 is also formed at the middle portion of the part equivalent to the bushing 671 provided to the front side of the drum unit 518, with which the abutting pin 514 comes into contact. The flange 673 of the one end side (front side) of the photosensitive drum 103 is rotatably inserted into the opening formed in the part equivalent to the bushing 671. The flange 673 rotates while rubbing against the inner wall face of this opening. That is to say, the part equivalent to the bushing 671 rotatably bears the photosensitive drum 103 at the front side, the same as the rear side of the drum unit 518.

The bushing 671 has a fitting portion 685 (abutted portion) to which the abutting pin 515 fits. The fitting portion 685 is provided with an abutting face 551, a rear-side wall face 596, and a tapered portion 585. The fitting portion 685 may be recessed as to the bushing 671, or may be erected. The abutting pin 515 that moves in the direction from the retracted position toward the exposure position abuts the abutting face 551. The lower edge of the fitting portion 685 has the tapered portion 585 formed, that is tapered. The tapered portion 585 guides movement of the abutting pin 515 heading from the retracted position toward the exposure position, so as to abut the abutting face 551. Contact of the rear-side wall face 596 and the abutting pin 515 will be described later.

The movement of the abutting pin 515 that has abutted the abutting face 551 of the fitting portion 685 is restricted in directions intersecting both the front-and-rear direction (longitudinal direction of holding member 505) and the vertical direction (the direction in which the holding member 505 moves between the exposure position and the retracted position, i.e., in the direction of reciprocal movement) by the fitting portion 685. That is to say, movement of the upper end of the abutting pin 515 is restricted in directions intersecting both the front-and-rear direction and the vertical direction by the fitting portion 685, and movement of the lower end of the abutting pin 515 is restricted in directions intersecting both the front-and-rear direction and the vertical direction by the restricting portion 128, with regard to the optical print head 105 situated in the exposure position (FIG. 7A2). Now, the difference between the diameter of the fitting portion 685 in the left-and-right direction and the diameter of the upper end of the abutting pin 515 in the left-and-right direction, and the difference between the diameter of the restricting portion 128 in the left-and-right direction and the diameter of the lower end of the abutting pin 515 in the left-and-right direction, are smaller than the difference between the gap in the left-and-right direction between the first wall face 588 and second wall face 589, and width in the left-and-right direction of the holding member 505 situated between the first wall face 588 and second wall face 589. Accordingly, when the optical print head 105 is in the exposure position, the first wall face 588 and second wall face 589 do not contribute to restriction of movement of the holding member 505 in directions intersecting either of the front-and-rear direction and the vertical direction.

Movement Mechanism

The movement mechanism 140 for moving the optical print head 105 will be described next. First, the first support portion 527 will be described. FIG. 9A is a schematic perspective view of the first support portion 527. Formed on the first support portion 527 are the abutting face 586, an opening 700, an abutting portion 529, restricting portion 127, protrusion 601, screw hole 602, positioning boss 603, positioning boss 604, and screw hole 605.

The abutting face 586 is a portion where the lower side of the holding member 505 moving from the exposure position toward the retracted position abuts, as described earlier. The lower side of the holding member 505 abuts the abutting face 586, and the optical print head 105 is at the retracted position.

A rod-shaped cleaning member for cleaning the light-emitting face of the lens array 506 contaminated by toner or the like is inserted in from the outer side of the main body of the image forming apparatus 1. The abutting portion 529 is a rear-side face of the first support portion 527, as indicated by hatching in FIG. 9A, and is regions above and below the opening 700. The function of the abutting portion 529 will be described later in detail.

The restricting portion 127 is a recess formed in the first support portion 527 and having the shape of a box with one side open, being opened toward the rear side, as illustrated in FIG. 9A. Part of the abutting pin 514 protruding from the lower side of the holding member 505 moves vertically along with the holding member 505 through the gap formed by the restricting portion 127. The restricting portion 127 is formed tapered, with the thickness in the vertical direction being smaller the closer to the abutting pin 514, to maximally reduce friction occurring due to contact with the abutting pin 514. Accordingly, the abutting pin 514 can smoothly move vertically in the gap of the restricting portion 127.

The first support portion 527 is fixed to the front-side face of the front-side plate 642. Multiple holes (omitted from illustration), corresponding to the positioning boss 603, positioning boss 604, and fixing screws are formed in the front-side plate 642. The positioning boss 603 and positioning boss 604 are inserted into respective holes of the multiple holes provided to the front-side plate 642, and in this state, the first support portion 527 is fixed to the front-side plate 642 by screws passed through the screw holes of the first support portion 527.

The third support portion 526, which will be described later, is sheet metal folded into the shape of a box with one side opened. FIG. 9B is a diagram for describing the way in which one end portion of the third support portion 526 in the longitudinal direction is inserted into the portion surrounded by a dotted line in FIG. 9A. FIG. 9C is a diagram illustrating the one end portion of the third support portion 526 in the longitudinal direction having been inserted into the portion surrounded by the dotted line in FIG. 9A. A notch is provided at the one end portion of the third support portion 526 as illustrated in FIGS. 9B and 9C, with the protrusion 601 of the first support portion 527 side engaging the notch of the third support portion 526. This engaging of the protrusion 601 with the notch in the third support portion 526 positions the third support portion 526 as to the first support portion 527 in the left-and-right direction. The third support portion 526 is pressed from the lower side in FIG. 9C by the screw inserted from the screw hole 602, and is fixed to the first support portion 527 by abutting a contact face 681 of the first support portion 527.

Next, the second support portion 528 will be described. FIG. 10A is a schematic perspective view of the second support portion 528. The abutting face 587, first wall face 588, second wall face 589, and restricting portion 128, are formed on the second support portion 528. The abutting face 587 is the portion that the lower side of the holding member 505 moving from the exposure position toward the retracted position abuts, as described earlier. The lower side of the holding member 505 abuts the abutting face 587, and thus the optical print head 105 is at the retracted position.

The second support portion 528 is fixed to the front-side face of the rear-side plate 643, as illustrated in FIG. 10B. The second support portion 528 is fixed to the rear-side plate 643 by positioning bosses and screws, in the same way that the first support portion 527 is fixed to the front-side plate 642. FIG. 10C illustrates a state where the other end side (rear side) of the third support portion 526 in the longitudinal direction of the third support portion 526 is inserted into the portion surrounded by a dotted line in FIG. 10A. That is to say, one end portion of the third support portion 526 is supported by the first support portion 527, and the other end portion is supported by the second support portion 528, with the first support portion 527 and the second support portion 528 being fixed to the front-side plate 642 and rear-side plate 643, respectively. In other words, the third support portion 526 is fixed to the main body of the image forming apparatus 1.

Note that an arrangement may be made where the second support portion 528 is fixed to the third support portion 526 by screws or the like, and is not fastened to the rear-side plate 643 by screws. In this case, a structure is made, for example, where a recessed portion is formed in the second support portion 528, which fits with a protruding portion formed on the rear-side plate 643, thereby positioning the second support portion 528 as to the rear-side plate 643. The first wall face 588 and second wall face 589 of the second support portion 528 will be described later.

The restricting portion 128 is a recess formed in the second support portion 528 and having the shape of a box with one side open, being opened toward the front side, as illustrated in FIG. 10A. Part of the abutting pin 515 protruding from the lower side of the holding member 505 moves vertically along with the holding member 505 through the gap formed by the restricting portion 128. The restricting portion 128 is formed tapered, to maximally reduce friction occurring due to contact with the abutting pin 515 with the thickness in the vertical direction being thinner, the closer to the abutting pin 515. Accordingly, the abutting pin 515 can smoothly move vertically in the gap of the restricting portion 128.

Next, the third support portion 526 and sliding portion 525 will be described with reference to FIGS. 11A and 11B. The third support portion 526 and sliding portion 525 are disposed on the opposite side of the holding member 505 from the photosensitive drum 103.

Figure 11A:
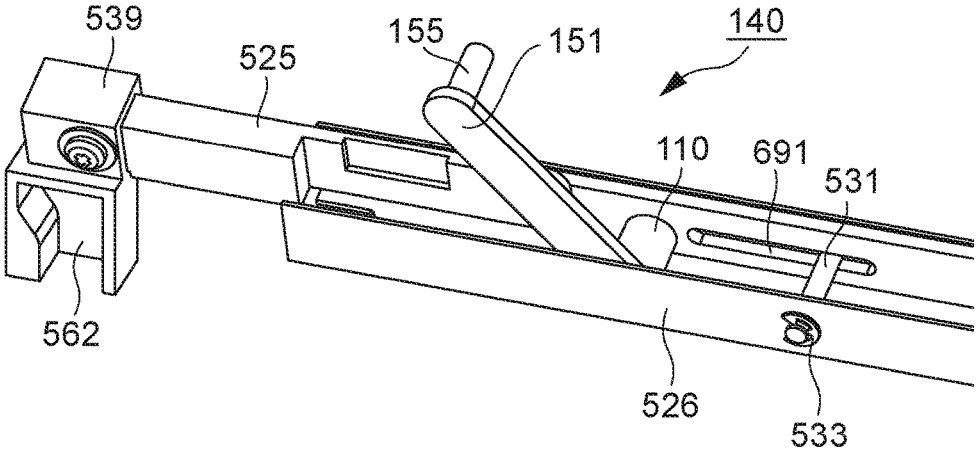
FIGS. 11A and 11B are perspective views of a movement mechanism, with the first support portion omitted from illustration.
Figure 11B:
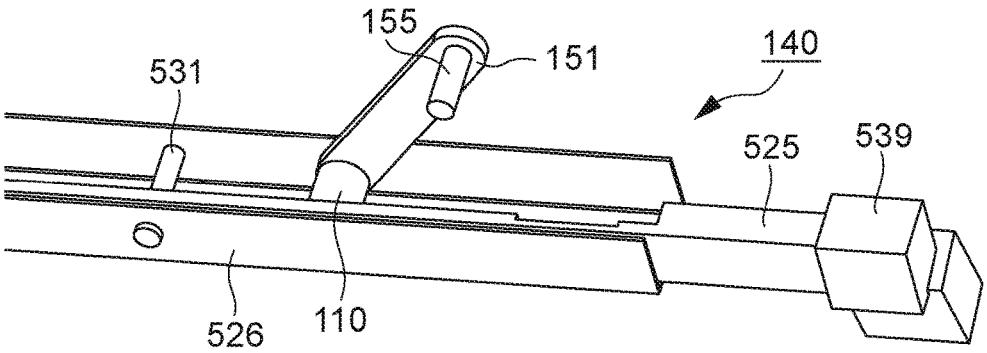

FIG. 11A is a schematic perspective view of the front side of the movement mechanism 140 as viewed from the left side, with the first support portion 527 omitted from illustration. FIG. 11B is a schematic perspective view of the front side of the movement mechanism 140 as viewed from the right side, with the first support portion 527 omitted from illustration. The movement mechanism 140 has the link member 151, the sliding portion 525, and the third support portion 526. The third support portion 526 has a support shaft 531 and an E-type snap ring 533. It can be seen from FIG. 11A that the support shaft 531 is inserted through openings formed in the opposing faces (left-side face and right-side face) of the third support portion 526 that has been formed into the shape of a box with one side open. The support shaft 531 passes through the right-side face and the left-side face of the third support portion 526. The support shaft 531 is retained by the E-type snap ring 533 on the outer side of the left-side face, so as not to fall out from the openings of the third support portion 526. On the other hand, a slot 691 that extends in the front-and-rear direction is formed in the sliding portion 525, as illustrated in FIG. 11A. The support shaft 531 is inserted through the slot 691 of the sliding portion 525. Accordingly, movement of the sliding portion 525 in the vertical direction as to the third support portion 526 is restricted, and the sliding portion 525 can only move by sliding as to the third support portion 526 by the length of the slot 691 in the front-and-rear direction.

A slide aiding member 539 having an accommodation space 562 from the left side to the lower side is attached to one end side of the sliding portion 525. The slide aiding member 539 is fixed to the sliding portion 525 by being fastened by a screw from the left side. The accommodation space 562 accommodates a later-described pressing member 561 that the cover 558 has. The relation between the accommodation space 562 and the pressing member 561, and structural features thereof, will be described later along with description of the cover 558.

Figure 12A:
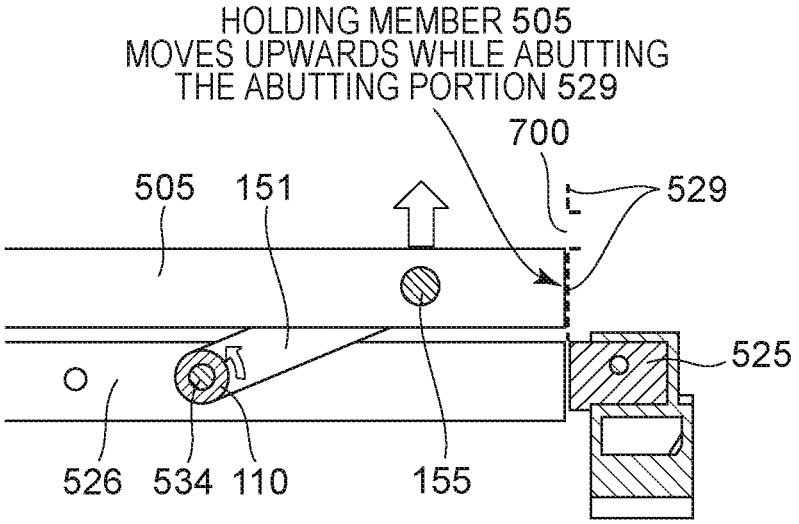
FIGS. 12A and 12B are side views of a link portion.

The arrangement by which the movement mechanism 140 moves the holding member 505 will be described with reference to FIGS. 11A through 12B. FIG. 12A is a cross-sectional view of the holding member 505 and the movement mechanism 140 illustrated in FIG. 11B, taken along the rotational axis of the photosensitive drum 103.

Figure 12B:
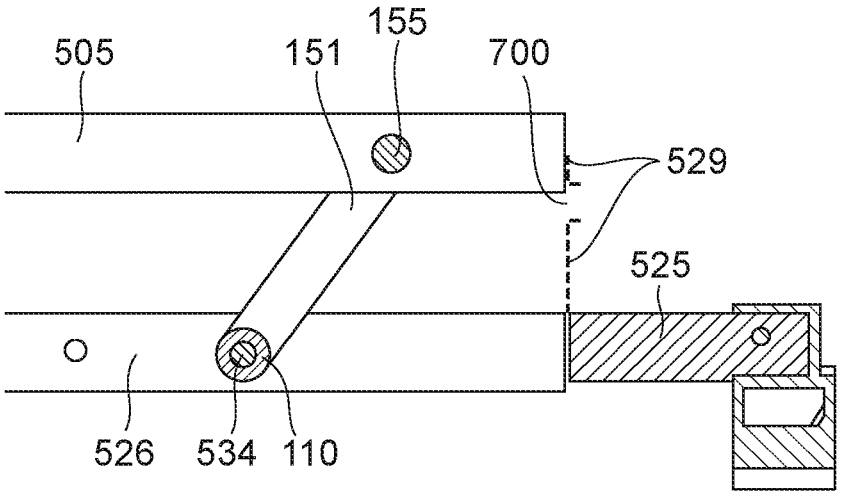

The link member 151 has a bearing 110 and a protrusion 155, as illustrated in FIGS. 12A and 12B. The bearing 110 is provided at the one end side of the link member 151 in the longitudinal direction. The protrusion 155 is, as illustrated in FIGS. 11A and 11B, a cylindrical protrusion that is provided on the other end side of the link member 151 in the longitudinal direction and that extends in the pivoting axis direction of the link member 151. The protrusion 155 is a protrusion for deforming a spring provided on the holding member 505 side of the optical print head 105. Note that the first moving portion is not restricted to being the protrusion 155, and may be a structure where the one end side in the longitudinal direction of the link member 151 is bent in the pivoting axis direction of the link member 151.

A circular hollowed space that extends in the left-and-right direction is formed in the bearing 110, as a hole. A fitting shaft portion 534 is provided to the sliding portion 525, as illustrated in FIGS. 12A and 12B. The fitting shaft portion 534 is a cylindrical protrusion erected from the sliding portion 525 toward the left. The hole of the bearing 110 is fit with the fitting shaft portion 534 so as to be capable of pivoting, thereby forming a first connecting portion. That is to say, the link member 151 is pivotable as to the sliding portion 525, with the first connecting portion as the center of pivoting. Note that an arrangement may be made where the fitting shaft portion 534 is formed on the link member 151 side, and the bearing 110 is formed on the sliding portion 525.

Note that a shaft the same as the support shaft 531 is provided at the rear side of the third support portion 526, a slot the same as the slot 691 is formed at the rear side of the sliding portion 525, and the structure of the rear side of the movement mechanism 140 is the same as the front side. The structure of the link member 152 serving as an example of a second moving member also is the same as the structure of the first moving member described above, with the link member 152 corresponding to the link member 151. The connecting portion of the one end side in the longitudinal direction of the link member 152 and the sliding portion 525 make up the second connecting portion, corresponding to the first connecting portion.

The abutting portion 529 of the first support portion 527 (omitted from illustration in FIGS. 11A through 12B) is disposed further toward the front side as compared to the one end of the holding member 505. Accordingly, when the sliding portion 525 moves by sliding as to the third support portion 526 from the rear side to the front side, the bearing 110 to which the fitting shaft portion 534 is fit also moves by sliding as to the third support portion 526 from the rear side to the front side, along with the sliding portion 525. The holding member 505 to which the protrusion 155 is attached also attempts to move from the rear side to the front side in conjunction with this, but the one end of the holding member 505 is abutting the abutting portion 529, and accordingly movement toward the front side is restricted. The link member 151 is disposed intersecting the rotational axis direction of the photosensitive drum 103 such that the one end side having the protrusion 155 is situated closer to the drum unit 518 side as compared to the other end side having the bearing 110, and accordingly pivots in a counter-clockwise direction with the fitting shaft portion 534 as the center of pivoting, as viewed from the right side as illustrated in FIG. 12A. Accordingly, the holding member 505 moves from the retracted position toward the exposure position with the one end of the holding member 505 abutting the abutting portion 529.

On the other hand, when the sliding portion 525 moves by sliding as to the third support portion 526 from the front side to the rear side, the bearing 110 fit to the fitting shaft portion 534 moves by sliding as to the third support portion 526 from the front side to the rear side, along with the sliding portion 525. Accordingly, the link member 151 pivots in a clockwise direction with the fitting shaft portion 534 as the center of pivoting, as viewed from the right side as illustrated in FIG. 12A. Thus, the protrusion 155 moves in a direction from the exposure position toward the retracted position. The sliding portion 525 moves from the rear side to the front side in conjunction with a closing operation of the cover 558, and moves from the front side to the rear side in conjunction with an opening operation of the cover 558, which will be described in detail later. That is to say, when the cover 558 moves from an opened state to a closed state, the holding member 505 moves in a direction from the retracted position toward the exposure position, and when the cover 558 moves from the closed state to the opened state, the holding member 505 moves in a direction from the exposure position toward the retracted position.

When the optical print head 105 moves generally in the optical axis direction of the lens, the rear side of the holding member 505 moves through a gap formed by the first wall face 588 and the second wall face 589 of the second support portion 528, as described earlier. This prevents the holding member 505 from tilting in the left or right directions.

Note that the link member 151 and link member 152 may be arranged such that the other end side is situated further toward the front side than the one end side, with the abutting portion 529 situated further toward the rear side than the other end of the holding member 505. That is to say, when the sliding portion 525 moves by sliding as to the third support portion 526 from the front side to the rear side, the bearing 110 to which the fitting shaft portion 534 is fit also moves by sliding as to the third support portion 526 from the front side to the rear side, along with the sliding portion 525. The holding member 505 to which the protrusion 155 is attached also attempts to move to the rear side in conjunction with this, but the other end of the holding member 505 is abutting the abutting portion 529, and accordingly movement toward the rear side is restricted. Accordingly, the link member 151 and link member 152 pivot in the clockwise direction as to the sliding portion 525 when viewing the link member 151 from the right side, and the holding member 505 moves from the retracted position toward the exposure position with the other end of the holding member 505 abutting the abutting portion 529. In this case, the cover 558 presses the sliding portion 525 from the front side toward the rear side when moving from the opened state to the closed state, and pulls the sliding portion 525 from the rear side toward the front side when moving from the closed state to the opened state.

The mechanism for moving the optical print head 105 is not restricted to the movement mechanism 140. A movement mechanism 640 illustrated in FIG. 13 may be used. The movement mechanism 640 will be described below with reference to FIGS. 13 through 15B. Note that members having substantially the same functions as members making up the movement mechanism 140 are denoted by the same reference numerals, and redundant description may be omitted.

Figure 13:
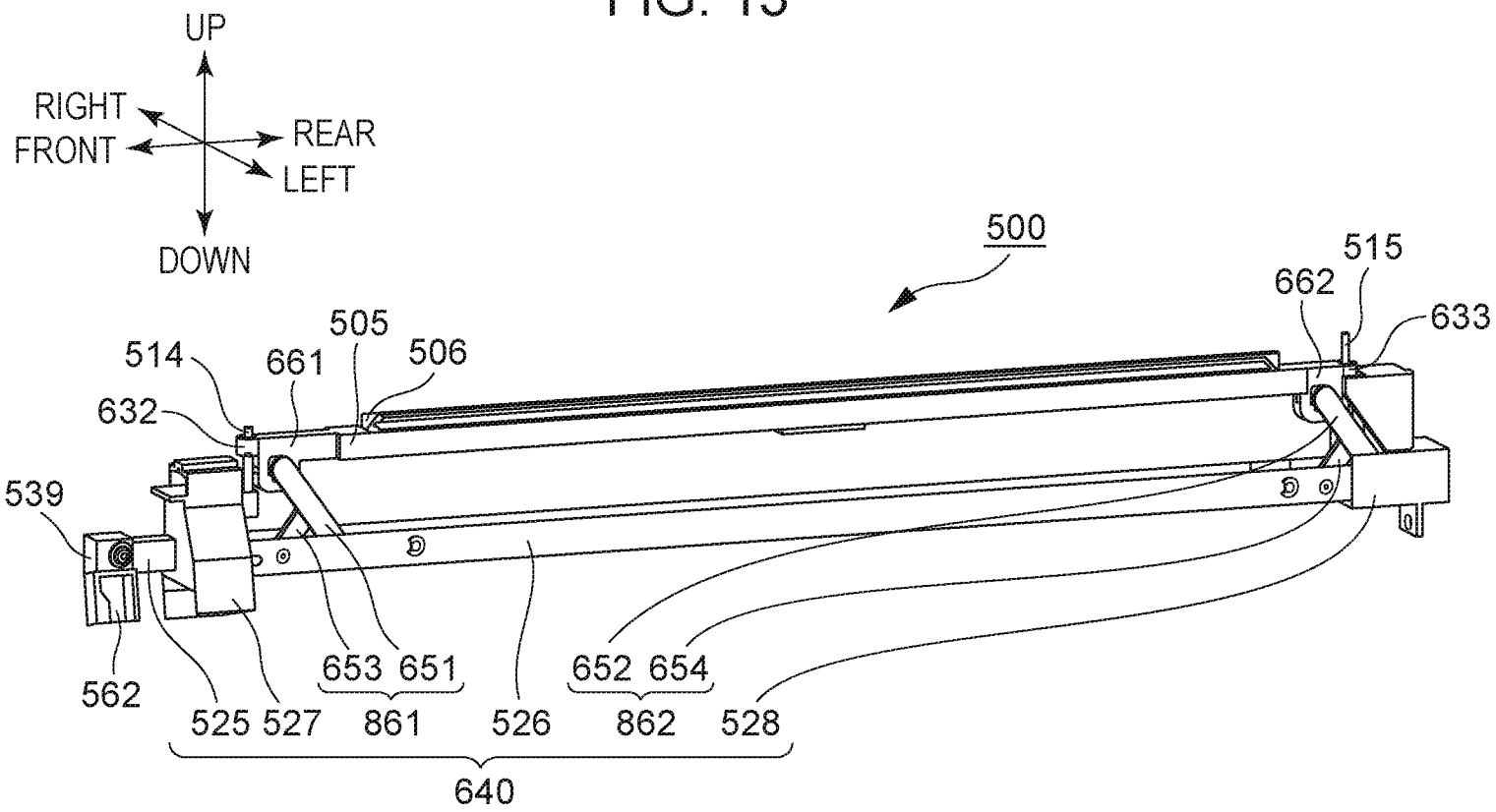
FIG. 13 is a schematic perspective view of an exposure unit having a movement mechanism that has a λ-type link mechanism.

FIG. 13 is a schematic perspective view of the exposing unit 500 having the movement mechanism 640. The movement mechanism 640 has the first link mechanism 861 serving as a first moving member, second link mechanism 862 serving as a second moving member, sliding portion 525, first support portion 527, second support portion 528, and third support portion 526, as illustrated in FIG. 13. The first link mechanism 861 includes the link member 651 and link member 653, and the second link mechanism 862 includes the link member 652 and link member 654. The link member 651 and link member 653, and link member 652 and link member 654, each make up a λ-type link mechanism, as illustrated in FIG. 13.

Figure 14A:
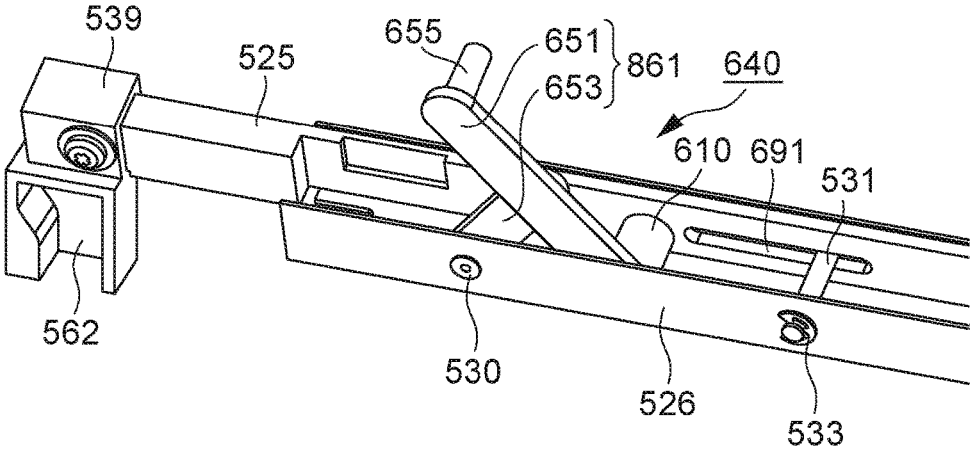
FIGS. 14A and 14B are perspective views of the movement mechanism that has the λ-type link mechanism, with the first support portion omitted from illustration.
Figure 14B:
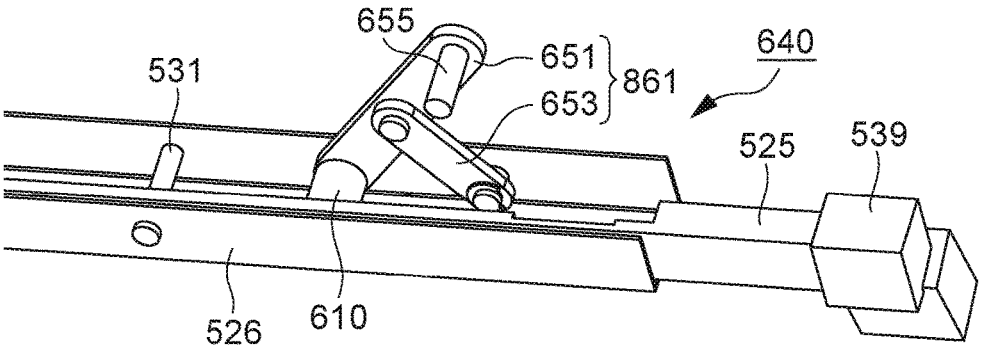

FIG. 14A is a schematic perspective view of the front side of the movement mechanism 640, as viewed from the left side, with the first support portion 527 omitted from illustration. FIG. 14B is a schematic perspective view of the front side of the movement mechanism 640, as viewed from the right side, with the first support portion 527 omitted from illustration.

Figure 15A:
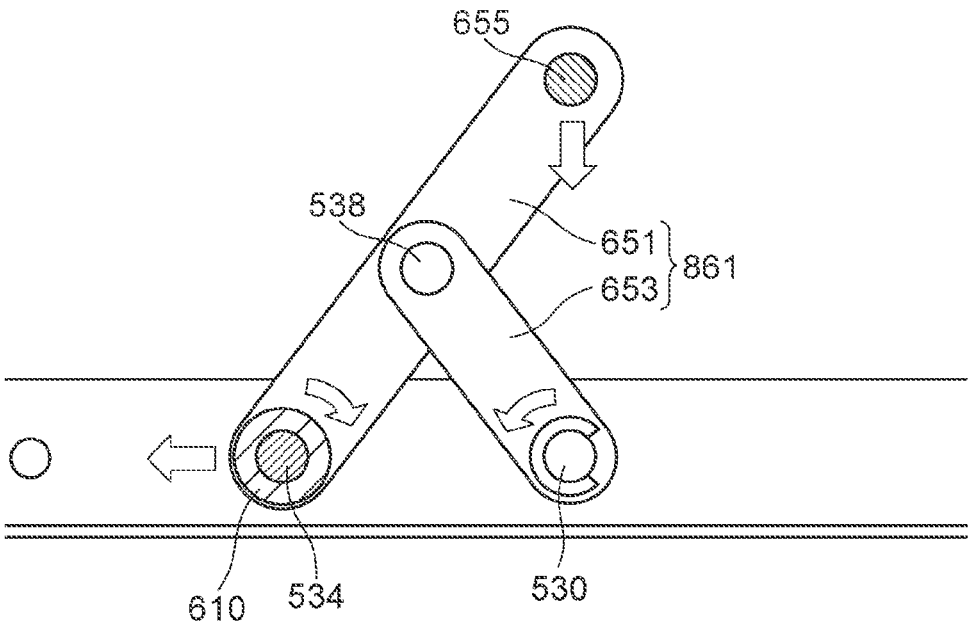
FIGS. 15A and 15B are side views of a λ-type first link mechanism.
Figure 15B:
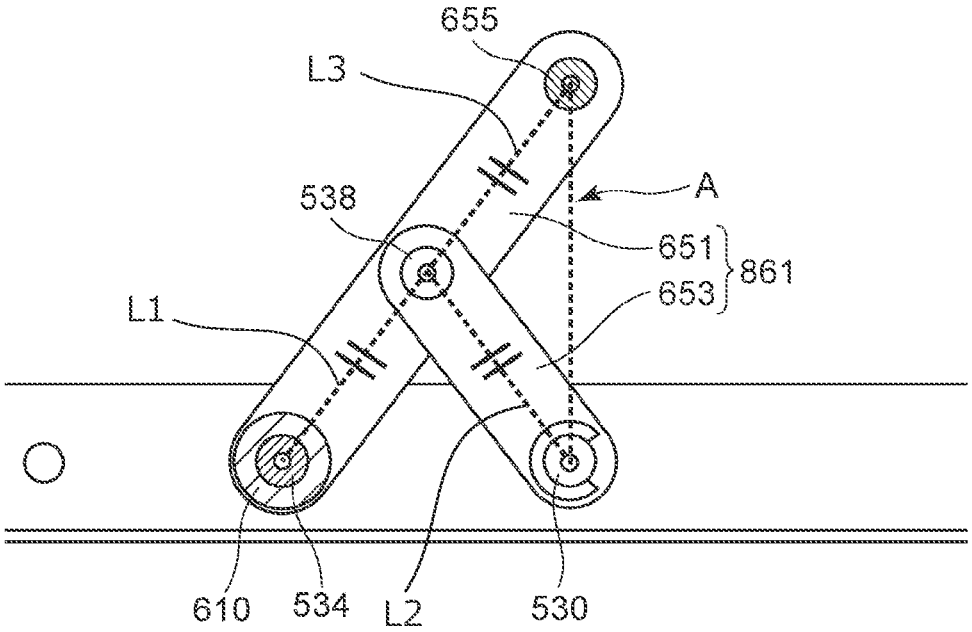

The first link mechanism 861 will be described with reference to FIGS. 14A through 15B. FIG. 15A is a diagram where a cross-sectional view of the first link mechanism 861 taken along the rotational axis of the photosensitive drum 103 is viewed from the right side. The first link mechanism 861 has the link member 651 and link member 653. The link member 651 and link member 653 making up the first link mechanism 861 are each single link members, but may be configured by combining multiple link members. The length of the link member 653 in the longitudinal direction is shorter than the length of the link member 651 in the longitudinal direction, as illustrated in FIGS. 14A and 14B.

The link member 651 has a bearing 610, a protrusion 655, and a connecting shaft portion 538. The bearing 610 is provided to one end side in the longitudinal direction of the link member 651. The protrusion 655 is a cylindrical protrusion extending in the pivoting axis direction of the link member 651 provided at the other end side in the longitudinal direction of the link member 651, for causing deformation of a spring provided to the holding member 505 side of the optical print head 105. The connecting shaft portion 538 is provided between the bearing 610 and protrusion 655 in the longitudinal direction of the link member 651. Although the protrusion 655 serves as a first moving portion, the first moving portion is not restricted to the protrusion 655, and may be a structure where one end side in the longitudinal direction of the link member 651 is bent in the pivoting axis direction.

A circular hollowed space that extends in the left-and-right direction in FIG. 15A is formed in the bearing 610, as a hole. A fitting shaft portion 534 is provided to the sliding portion 525. The fitting shaft portion 534 is a cylindrical protrusion erected from the sliding portion 525 to the left direction in FIG. 15A. The fitting shaft portion 534 forms a first connecting portion by being pivotably fit to the hole of the bearing 610. That is to say, the link member 651 is capable of pivoting as to the sliding portion 525, with the first connecting portion as the center of pivoting. Note that the fitting shaft portion 534 may be formed on the link member 651 side, and the bearing 610 formed on the sliding portion 525.

The link member 653 has a connecting shaft portion 530. The connecting shaft portion 530 is provided to one end side in the longitudinal direction of the link member 653. The connecting shaft portion 530 is a cylindrical protrusion erected from the link member 653 to the right side in FIG. 15A. The connecting shaft portion 530 is inserted into a hole formed in the third support portion 526, and thus forms a third connecting portion. The connecting shaft portion 530 may be formed to the third support portion 526 rather than the link member 653. That is to say, the connecting shaft portion 530 formed on the third support portion 526 may be inserted to a hole formed in the link member 653.

A circular hole that extends in the left-and-right direction in FIG. 15A is formed at the other end side in the longitudinal direction of the link member 653. The connecting shaft portion 538 of the link member 651 is pivotably inserted into his hole, whereby the connecting shaft portion 538 and the hole of the link member 653 make up a fourth connecting portion. That is to say, the link member 653 is capable of pivoting as to the third support portion 526 with the third connecting portion as a center of pivoting, and is capable of pivoting as to the link member 651 with the fourth connecting portion as a center of pivoting. Now, the connecting shaft portion 538 may be formed on the link member 653 rather than the link member 651. That is to say, the connecting shaft portion 538 formed on the link member 653 may be inserted into a hole formed in the link member 651.

Note that the configuration of the second link mechanism 862 is the same as the configuration of the first link mechanism 861 described above. The link member 652 and link member 654 that the second link mechanism 862 has correspond to the link member 651 and link member 653, respectively. The one end side in the longitudinal direction of the link member 652 and the connecting portion of the sliding portion 525 make up a second connecting portion, corresponding to the first connecting portion. Note that one of the link member 653 and link member 654 may be omitted from the embodiment regarding the movement mechanism 640.

According to the above configuration, when the sliding portion 525 moves by sliding from the front side toward the rear side with regard to the third support portion 526, the bearing 610 to which the fitting shaft portion 534 has been fit moves by sliding from the front side toward the rear side as to the third support portion 526, along with the sliding portion 525. Accordingly, when viewing the first link mechanism 861 from the right side as illustrated in FIG. 15A, the link member 651 pivots in the clockwise direction with the fitting shaft portion 534 as the center of pivoting, and the link member 653 pivots in the counter-clockwise direction with the connecting shaft portion 530 as the center of pivoting. Accordingly, the protrusion 655 moves in a direction from the exposure position toward the retracted position.

On the other hand, when the sliding portion 525 moves by sliding from the rear side toward the front side as to the third support portion 526, the link member 651 and link member 653 moves by sliding in the opposite directions as to the arrows in FIG. 15A. When the sliding portion 525 moves from the rear side toward the front side with regard to the third support portion 526, the bearing 610 to which the fitting shaft portion 534 has been fit moves by sliding from the rear side toward the front side as to the third support portion 526, along with the sliding portion 525. Accordingly, when viewing the first link mechanism 861 from the right side as illustrated in FIG. 15A, the link member 651 pivots in the counter-clockwise direction with the fitting shaft portion 534 as the center of pivoting, and the link member 653 pivots in the clockwise direction with the connecting shaft portion 530 as the center of pivoting. Accordingly, the protrusion 655 moves in a direction from the retracted position toward the exposure position.

Now, (1) the distance between the pivoting center axis of the connecting shaft portion 538 and the pivoting center axis of the bearing 610 will be referred to as L1, (2) the distance between the pivoting center axis of the connecting shaft portion 538 and the pivoting center axis of the connecting shaft portion 530 will be referred to as L2, and (3) the distance between the pivoting center axis of the connecting shaft portion 538 and the pivoting center axis of the protrusion 655 will be referred to as L3. In the movement mechanism 640, the first link mechanism 861 forms a Scott Russel linkage where L1, L2, and L3 are equal (see FIG. 15B). The protrusion 655 moves perpendicular (along line A in FIG. 15B) to the direction of sliding movement of the fitting shaft portion 534 due to the distances L1, L2, and L3 being equal, so the optical print head 105 can be moved generally in the optical axis direction of the lens in the above-described link mechanism.

A configuration may be made where the front-and-rear directions of the first link mechanism 861 and second link mechanism 862 are opposite, so that when the sliding portion 525 is moved by sliding from the front side toward the rear side, the optical print head 105 moves from the retracted position toward the exposure position, and when the sliding portion 525 is moved by sliding from the rear side toward the front side, the optical print head 105 moves from the exposure position toward the retracted position. In this case, the later-described cover 558 presses the sliding portion 525 from the front side toward the rear side when moving from an opened state to a closed state, and pulls the sliding portion 525 from the rear side toward the front side when moving from a closed state to an opened state.

The mechanism for moving optical print head 105 is not restricted to the movement mechanism 140 or movement mechanism 640. A movement mechanism 840 illustrated in FIGS. 16A1 through 16B may be used. The movement mechanism 640 will be described below with reference to FIGS. 16A1 through 16B. Members which have substantially the same functions as the members making up the movement mechanism 840 are denoted by the same reference numerals, and redundant description may be omitted.

FIGS. 16A1 through 16B illustrate the movement mechanism 840. The movement mechanism 840 includes a first link mechanism 858 serving as an example of a first moving member, a second link mechanism 859 serving as an example of a second moving member, sliding portion 825, and the third support portion 526, as illustrated in FIGS. 16A1 through 16B. The first link mechanism 858 includes a link member 843 and a link member 844, and the second link mechanism 859 includes a link member 845 and a link member 846. The link member 843 and link member 844, and the link member 845 and link member 846, each pivotably intersect each other, making up an X-shaped link mechanism as illustrated in FIGS. 16A1 through 16B. A protrusion 847 of the link member 843, a protrusion 848 of the link member 844, a protrusion 849 of the link member 845, and a protrusion 850 of the link member 846, are each pivotably attached to a holding member 805 that is omitted from illustration. When a sliding portion 825 is moved by sliding in the direction of the arrow D in FIG. 16A1, the link members 843 through 846 pivot with regard to the sliding portion 825, and the protrusions 847 through 850 move downwards (FIG. 16A2). On the other hand, when the sliding portion 825 is moved by sliding in the direction of the arrow E in FIG. 16A2, the link members 843 through 846 pivot with regard to the sliding portion 825, and the protrusions 847 through 850 move upwards (FIG. 16A1).

FIG. 16B is a diagram illustrating the front side of the movement mechanism 840 with the front side of the holding member 805. The arrangement by which the movement mechanism 840 moves the holding member 805 will be described below with reference to FIG. 16B. Now, the first link mechanism 858 and second link mechanism 859 are substantially the same, so the first link mechanism 858 will be described here with reference to FIG. 16B. The first link mechanism 858 has the link member 843 and link member 844. The link member 843 and link member 844 making up the first link mechanism 858 are single members, but may be configured by combining multiple members.

The movement mechanism 840 in FIG. 16B has the first link mechanism 858 and sliding portion 825. The sliding portion 825 has a slot 863 that is an elongated opening, passing through the sliding portion 825 in the left-and-right direction and extending in the front-and-rear direction, as illustrated in FIG. 16B.

The link member 843 has a protrusion 810, the protrusion 847, and the connecting shaft portion 538. The protrusion 810 is provided to one end side in the longitudinal direction of the link member 843. The protrusion 847 is a cylindrical protrusion extending to the right side in the pivoting axial direction of the link member 843, provided to the other end side in the longitudinal direction of the link member 843. The connecting shaft portion 538 is provided between the protrusion 810 and protrusion 847 in the longitudinal direction of the link member 843. Although the protrusion 847 serves as a first moving portion, the first moving portion is not restricted to the protrusion 847, and may be a structure where one end side in the longitudinal direction of the link member 843 is bent in the pivoting axis direction.

The protrusion 810 is pivotably fit to the slot 863 of the sliding portion 825, thereby forming the first connecting portion. That is to say, the link member 843 is pivotable as to the sliding portion 825 with the first connecting portion as the center of pivoting. The protrusion 810 is capable of moving in the slot 863 in the front-and-rear direction within the range of the slot 863 in the front-and-rear direction (within the opening). A coil spring 860 is disposed between the rear-side edge of the slot 863 and the protrusion 810.

The link member 844 has the connecting shaft portion 530 and the protrusion 848. The connecting shaft portion 530 is provided to one end side in the longitudinal direction of the link member 844. The connecting shaft portion 530 is a cylindrical protrusion erected from the link member 844 to the left side in FIG. 16B. The connecting shaft portion 530 is pivotably inserted into a hole formed in the third support portion 526, thereby forming the third connecting portion. Now, the connecting shaft portion 530 may be formed on the third support portion 526 rather than the link member 844. That is to say, the connecting shaft portion 530 formed on the third support portion 526 may be inserted into a hole formed in the link member 844.

The protrusion 848 is a cylindrical protrusion provided to the other end side in the longitudinal direction of the link member 844, erected to the right side in the pivoting axis direction of the link member 844. A circular hole that extends in the left-and-right direction in FIG. 16B is formed between the protrusion 848 of the link member 844 and the third connecting portion. The connecting shaft portion 538 of the link member 843 is pivotably inserted into this hole, whereby the connecting shaft portion 538 and the hole of the link member 844 make up the fourth connecting portion. That is to say, the link member 844 is capable of pivoting as to the third support portion 526 with the third connecting portion as a center of pivoting, and is capable of pivoting as to the link member 843 with the fourth connecting portion as a center of pivoting. Now, the connecting shaft portion 538 may be formed on the link member 844 rather than the link member 843. That is to say, the connecting shaft portion 538 formed on the link member 844 may be inserted into a hole formed in the link member 843. Note that one of the link member 843 and link member 844 may be omitted from the embodiment regarding the movement mechanism 840.

The holding member 805 has the lens array 506, a link attaching portion 851, a link attaching portion 852, and a pin attaching portion 855. The link attaching portion 851 and link attaching portion 852 both are provided between pins 514 attached to the lens array 506 and holding member 805. Although omitted from illustration, a link attaching portion 853 and link attaching portion 854 to which the link member 845 and link member 846 making up the second link mechanism 859 are attached are both provided between pins 515 attached to the other end side of the lens array 506 and holding member 805. The link attaching portion 851 is a hole formed in the holding member 805 between the lens array 506 and pin attaching portion 855, passing through in the left-and-right direction. The link attaching portion 852 is a slot that is formed in the holding member 805 between the lens array 506 and the link attaching portion 851, and that passes through in the left-and-right direction and extends in the front-and-rear direction.

The protrusion 847 of the link member 843 is pivotably attached to the link attaching portion 851, and the protrusion 848 of the link member 844 is pivotably attached to the link attaching portion 852. The protrusion 848 is attached to the link attaching portion 851 so as to be capable of moving in the front-and-rear direction. Accordingly, the link member 844 is capable of moving by sliding in the front-and-rear direction within the range of the link attaching portion 852 in the front-and-rear direction, while pivoting with the protrusion 848 as a center of pivoting.

According to the above-described configuration, when the sliding portion 825 moves by sliding from the front side to the rear side as to the third support portion 526, the protrusion 810 moves by sliding from the front side to the rear slide as to the third support portion 526 along with the sliding portion 825. Accordingly, when viewing the first link mechanism 858 from the right side as illustrated in FIG. 15A1, the protrusion 848 moves from the front side to the rear side at the link attaching portion 852 with the link member 843 pivoting clockwise with the protrusion 810 as the center of pivoting and the link member 844 pivoting counter-clockwise with the connecting shaft portion 530 as the center of pivoting. Accordingly, the protrusion 847 and protrusion 848 move in the direction from the exposure position toward the retracted position.

On the other hand, when the sliding portion 825 moves by sliding from the rear side to the front side as to the third support portion 526, the protrusion 810 moves by sliding from the rear side to the front slide as to the third support portion 526 along with the sliding portion 825. Accordingly, when viewing the first link mechanism 858 from the right side as illustrated in FIG. 16A2, the protrusion 848 moves from the rear side to the front side at the link attaching portion 852 with the link member 843 pivoting counter-clockwise with the protrusion 810 as the center of pivoting and the link member 844 pivoting clockwise with the connecting shaft portion 530 as the center of pivoting. Accordingly, the protrusion 847 and protrusion 848 move from the retracted position toward the exposure position. When the sliding portion 825 further moves by sliding to the front side in a state where the abutting pin 514 is in contact with an abutting face 550, as illustrated in FIG. 16B, the coil spring 860 is compressed between the rear side edge of the slot 863 and the protrusion 810. The protrusion 810 is biased to the front side by the restoring force of the compressed coil spring 860. Accordingly, biasing force heading upwards is applied to the holding member 805.

A configuration may be made where the front-and-rear directions of the first link mechanism 858 and second link mechanism 859 are opposite, so that when the sliding portion 825 is moved by sliding from the front side toward the rear side, the optical print head 105 moves from the retracted position toward the exposure position, and when the sliding portion 825 is moved by sliding from the rear side toward the front side, the optical print head 105 moves from the exposure position toward the retracted position. In this case, the later-described cover 558 presses the sliding portion 825 from the front side toward the rear side when moving from an opened state to a closed state, and pulls the sliding portion 825 from the rear side toward the front side when moving from a closed state to an opened state.

The mechanism for moving the optical print head 105 is not restricted to the movement mechanism 140, movement mechanism 640, and movement mechanism 840. A movement mechanism 940 illustrated in FIGS. 17A and 17B may be used. The movement mechanism 940 will be described below with reference to FIGS. 17A and 17B. Note that members having substantially the same functions as members making up the movement mechanism 940 are denoted by the same reference numerals, and redundant description may be omitted.

Figure 17A:
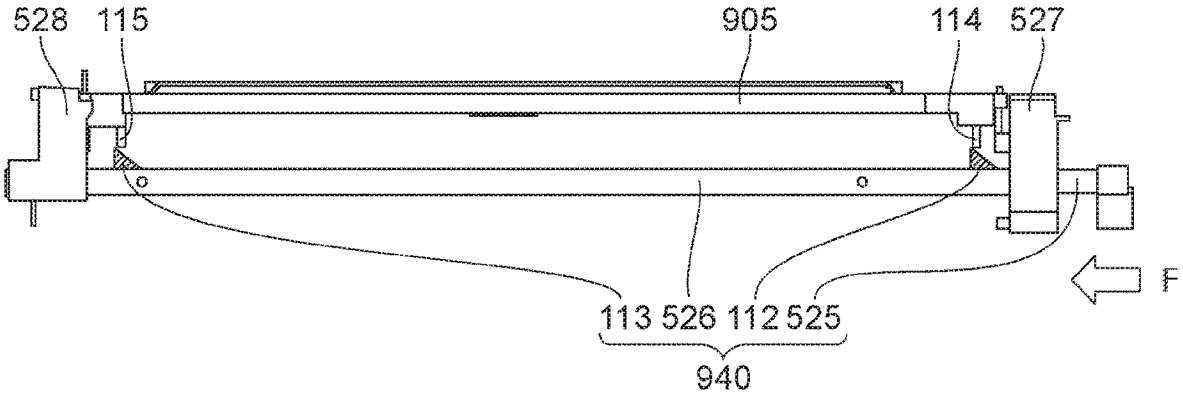
FIGS. 17A and 17B are diagrams for describing a movement mechanism using a cam mechanism.
Figure 17B:
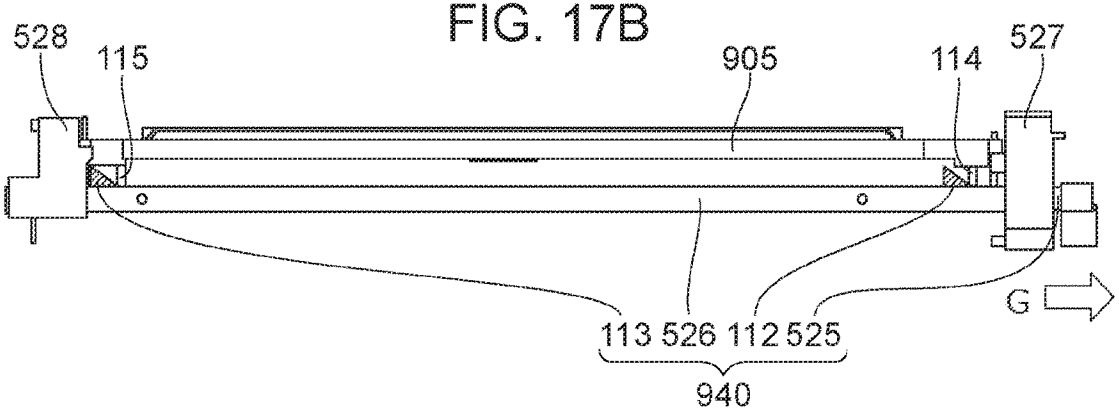

As illustrated in FIGS. 17A and 17B, a first cam portion 112 and a second cam portion 113 are provided to the front side and rear side of the sliding portion 525. A movement support portion 114 serving as a first moving member and a movement support portion 115 serving as a second moving member are provided to the front side and rear side at the lower side of the holding member 905. The first cam portion 112 and second cam portion 113 have a face inclined downwards from the rear side toward the front side as to the holding member 905 side.

FIG. 17A is a schematic diagram illustrating the optical print head 105 situated at the exposure position and the movement mechanism 940, as viewed from the right side. When the sliding portion 525 moves by sliding from the front side to the rear side as to the third support portion 526 in a case where the optical print head 105 is at the exposure position, the first cam portion 112 and second cam portion 113 provided to the sliding portion 525 move by sliding from the front side to the rear side as to the third support portion 526, along with the sliding portion 525. Accordingly, the lower ends of the movement support portion 114 and movement support portion 115 provided to the holding member 905 abut the first cam portion 112 and second cam portion 113, and the movement support portion 114 and movement support portion 115 move along the first cam portion 112 and second cam portion 113 in a direction from the exposure position toward the retracted position.

FIG. 17B is a schematic diagram illustrating the optical print head 105 situated at the retracted position and the movement mechanism 940, as viewed from the right side. When the sliding portion 525 moves by sliding from the rear side to the front side as to the third support portion 526 in a case where the optical print head 105 is at the retracted position, the first cam portion 112 and second cam portion 113 provided to the sliding portion 525 move by sliding from the rear side to the front side as to the third support portion 526, along with the sliding portion 525. Accordingly, the lower ends of the movement support portion 114 and movement support portion 115 provided to the holding member 905 are pressed upwards and move along the first cam portion 112 and second cam portion 113 in a direction from the retracted position toward the exposure position.

Now an arrangement may be made where the direction of inclination of the inclined faces that the first cam portion 112 and second cam portion 113 have is inclined downwards from the front side toward the rear side, with sliding movement of the sliding portion 525 from the front side to the rear side moving the optical print head 105 from the retracted position toward the exposure position, and sliding movement of the sliding portion 525 from the rear side to the front side moving the optical print head 105 from the exposure position toward the retracted position. In this case, the later-described cover 558 presses the sliding portion 525 from the front side toward the rear side when moving from an opened state to a closed state, and pulls the sliding portion 525 from the rear side toward the front side when moving from a closed state to an opened state.

Next, the cover 558 will be described with reference to FIGS. 18A through 18C. The cover 558 is a member for causing the sliding portion 525 to move by sliding as described above. Note that the configuration causing the sliding portion 525 to move by sliding is not restricted to the cover 558. For example, a configuration may be made where the sliding portion 525 moves by sliding in conjunction with opening/closing of an unshown front door. Alternatively, a configuration may be made where the sliding portion 525 moves by sliding in conjunction with turning of a turning member such as a lever or the like, rather than a covering member such as the cover 558 or a door.

Figure 18A:
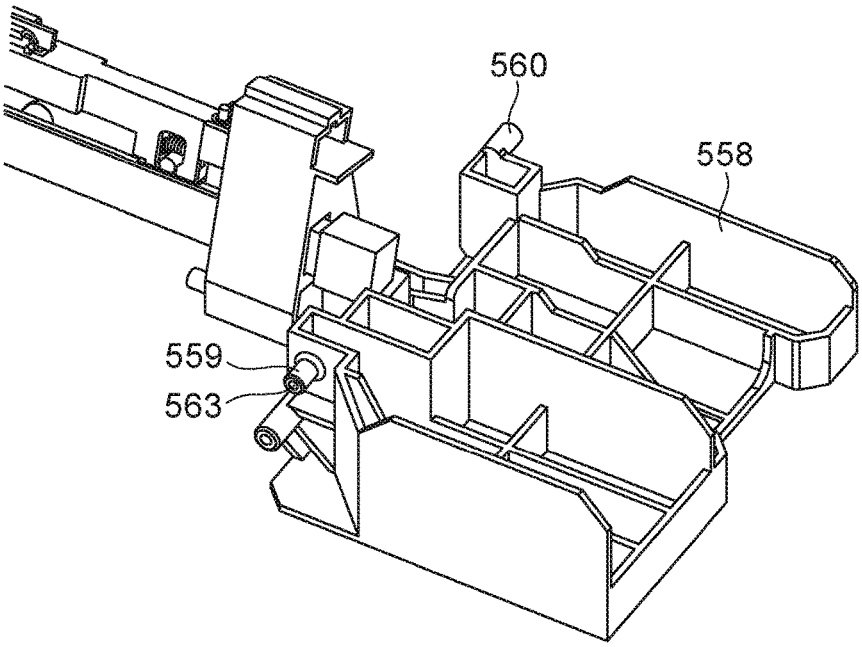
FIG. 18A through 18C are perspective views of a cover.

FIG. 18A is a perspective view of the cover 558. The cover 558 has a pivoting shaft portion 559 and a pivoting shaft portion 560, as illustrated in FIG. 18A. The pivoting shaft portion 559 is a cylindrical protrusion protruding in the right-side direction of the cover 558, while the pivoting shaft portion 560 is a cylindrical protrusion protruding in the left-side direction of the cover 558.

Figure 18B:
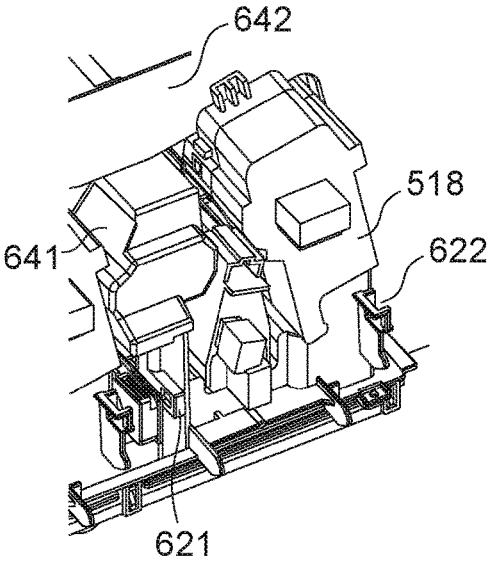
Figure 18C:
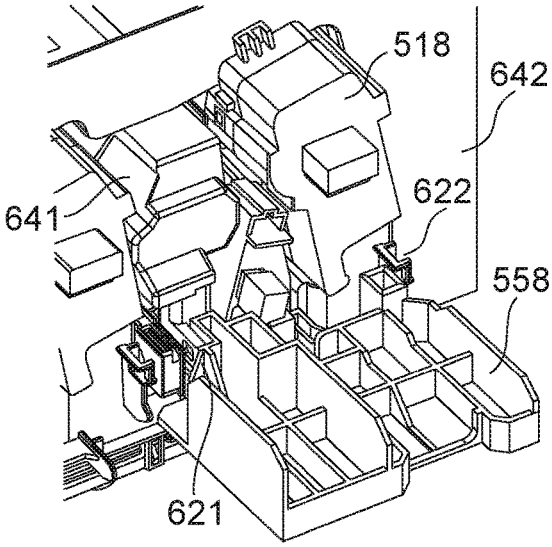

FIG. 18B is an enlarged view of the portion where the cover 558 is attached to the front-side plate 642. FIG. 18C is a perspective view of the cover 558 that has been attached to the front-side plate 642. The front-side plate 642 has a bearing member 621 to which the pivoting shaft portion 559 of the cover 558 fits, and a bearing member 622 to which the pivoting shaft portion 560 fits, as illustrated in FIG. 18B. The pivoting shaft portion 559 of the cover 558 pivotably fits to the bearing member 621 of the front-side plate 642, and the pivoting shaft portion 560 pivotably fits to the bearing member 622 of the front-side plate 642, as illustrated in FIG. 18C. The pivoting axis of the pivoting shaft portion 559 and the pivoting axis of the pivoting shaft portion 560 are on a pivoting axis 563, as illustrated in FIG. 18A. The cover 558 opens and closes as to the main body of the image forming apparatus 1, with the pivoting axis 563 as the center of pivoting. The closed cover 558 is situated on the inserting/extracting path of the drum unit 518 and developing unit 641. Accordingly, when the cover 558 is in a closed state, replacement of the drum unit 518 and developing unit 641 cannot be performed by the worker. The worker can replace the drum unit 518 by opening the cover 558, and closes the cover 558 when the work is completed.

Figure 19A:
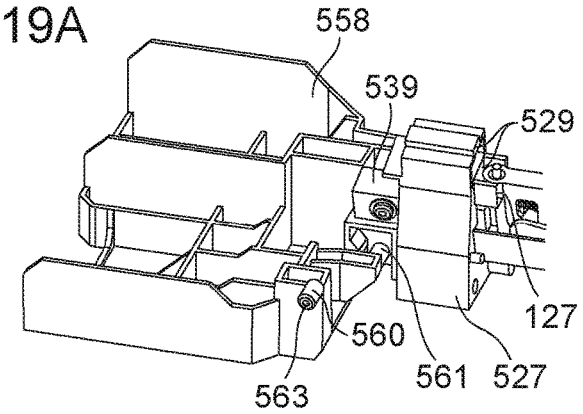
FIGS. 19A through 19D are perspective views of a cover, for description of operations when the cover is closed.
Figure 19B:
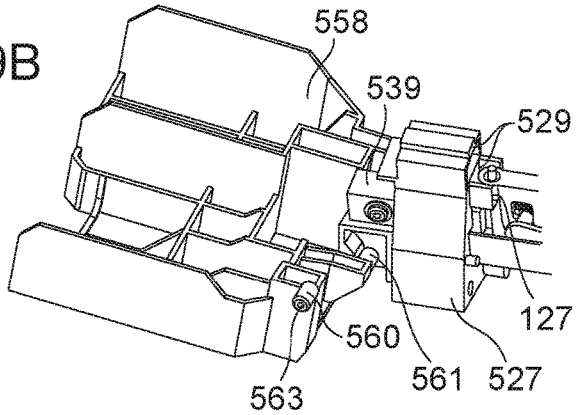

Next, the configuration by which the sliding portion 525 moves by sliding in the pivoting axis direction of the photosensitive drum 103 in conjunction with opening/closing operations of the cover 558 will be described with reference to FIGS. 19A through 22D. FIGS. 19A through 19D are perspective diagrams illustrating the cover 558 pivoting from an opened state toward a closed state. FIGS. 20A through 20D are cross-sectional views illustrating the cover 558 pivoting from the opened state toward the closed state. FIGS. 19A and 20A illustrate the opened state of the cover 558. FIGS. 19D and 20D illustrate the closed state of the cover 558. FIGS. 19B and 20B, and FIGS. 19C and 20C, are diagrams illustrating the cover 558 transitioning from the opened state to the closed state. Note that the closed state of the cover 558 in the closed state illustrated in FIGS. 19D and 20D is maintained by a snap fit mechanism for engaging to the main body, a stopper for preventing pivoting, or the like.

The cover 558 pivots as to the main body of the image forming apparatus 1 on the pivoting axis 563, as illustrated in FIGS. 19A through 19D. The cover 558 has the cylindrical pressing member 561 protruding from the left side toward the right side. The pressing member 561 is situated within the accommodation space 562 provided to the one end of the sliding portion 525, as illustrated in FIGS. 19A through 19D. The pressing member 561 moves over the movement path 564 in conjunction with the pivoting of the cover 558, as illustrated in FIGS. 20A through 20D.

Figure 20A:
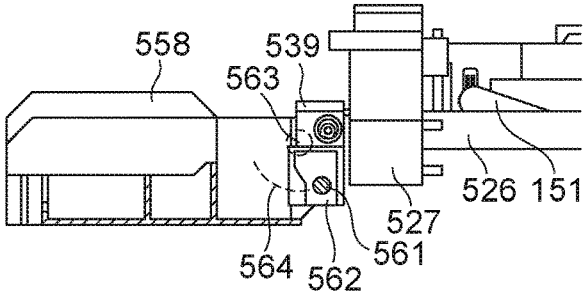
FIGS. 20A through 20D are perspective views of a cover, for description of operations when the cover is closed.
Figure 20B:
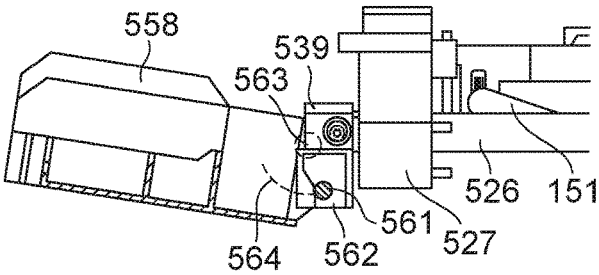

The operations of the pressing member 561 on the sliding portion 525 will be described with reference to FIGS. 20A through 20D. When the cover 558 pivots in the clockwise direction from the state in FIG. 20A, the pressing member 561 is situated on the movement path 564, and abuts a first pressed portion 566 intersecting the movement path 564 (FIG. 20B). When the cover 558 further pivots in the clockwise direction from this state, the pressing member 561 presses the first pressed portion 566 to the front side while rubbing against the first pressed portion 566. Accordingly, the slide aiding member 539 moves toward the front side. The slide aiding member 539 is fixed to the sliding portion 525, so the sliding portion 525 also moves by sliding toward the front side, in conjunction with the movement of the slide aiding member 539.

Figure 20C:
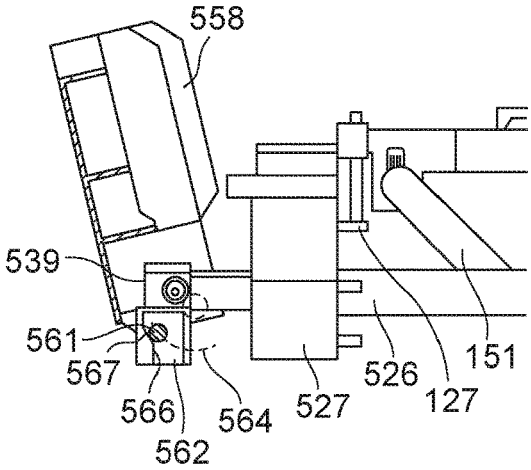

Further, when the cover 558 pivots even more in the clockwise direction, the pressing member 561 moves from the first pressed portion 566 to a second pressed portion 567 (FIG. 20C). The second pressed portion has a curved face that generally follows the movement path 564 of the pressing member 561. Accordingly, in a case where the cover 558 further pivots in the clockwise direction from the state in FIG. 20C, the pressing member 561 comes into contact with the second pressed portion 567 and moves upwards, but no force for further moving the slide aiding member 539 by sliding toward the front side is applied from the pressing member 561.

Figure 19C:
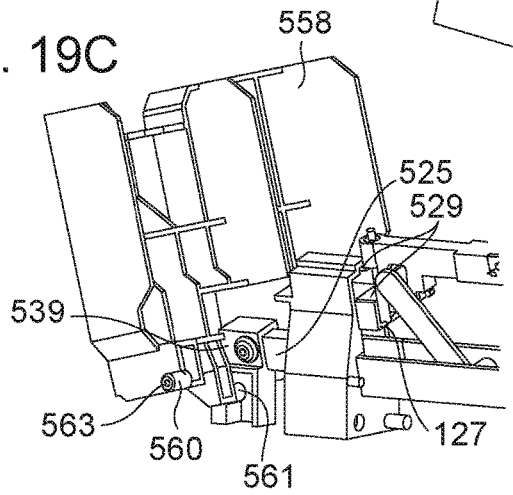
Figure 19D:
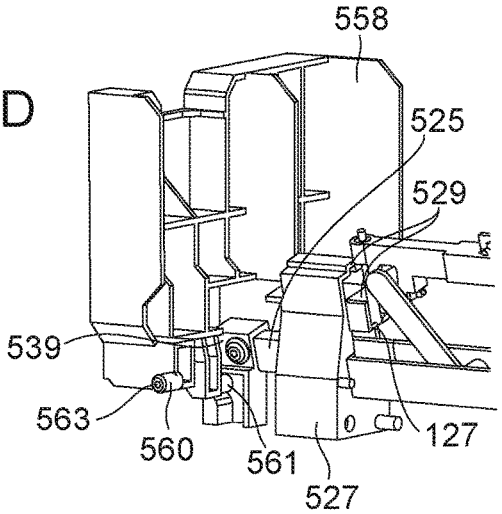
Figure 20D:
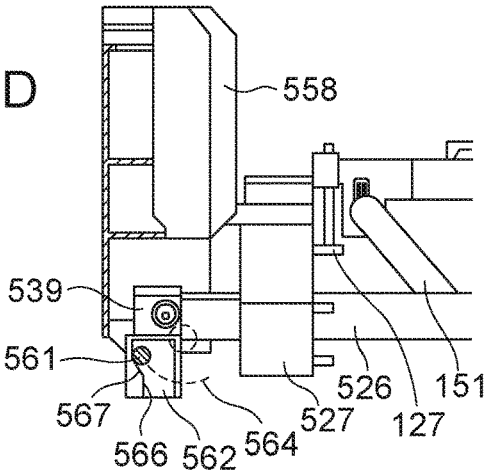

It can be seen from FIGS. 19C and 20C that when the cover 558 pivots from the opened state toward the closed state, the pressing member 561 abuts the second pressed portion 567 at the front side of the accommodation space 562 immediately after the holding member 505 has reached the exposure position. The second pressed portion 567 has a shape generally following the movement path 564 of the pressing member 561, which is an arc shape centered on the pivoting axis 563. Accordingly, in a case of further pivoting the cover 558 from the state in FIG. 20C in the clockwise direction, the pressing member 561 moves sliding over the second pressed portion 567 that it abuts. However, no force to further move the slide aiding member 539 toward the front side is applied from the pressing member 561. Accordingly, the slide aiding member 539 does not move from the rear side toward the front side while the pressing member 561 is moving over the second pressed portion 567. That is to say, the movement mechanism 140 according to the present embodiment is configured such that when the cover 558 pivots in a state where the pressing member 561 is abutting the first pressed portion 566, the sliding portion 525 moves by sliding in conjunction with the movement of the pressing member 561, but the sliding portion 525 does not move by sliding even if the cover 558 pivots in a state where the pressing member 561 is abutting the second pressed portion 567. By further pivoting the cover 558 from the state in FIG. 20C in the clockwise direction, the cover 558 reaches the closed state illustrated in FIG. 20D.

Figure 21A:
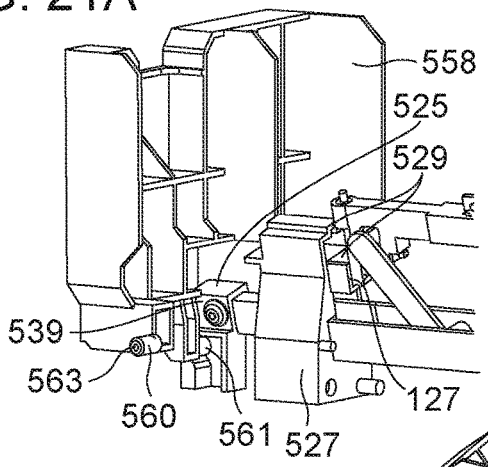
FIGS. 21A through 21D are perspective views of a cover, for description of operations when the cover is opened.
Figure 21B:
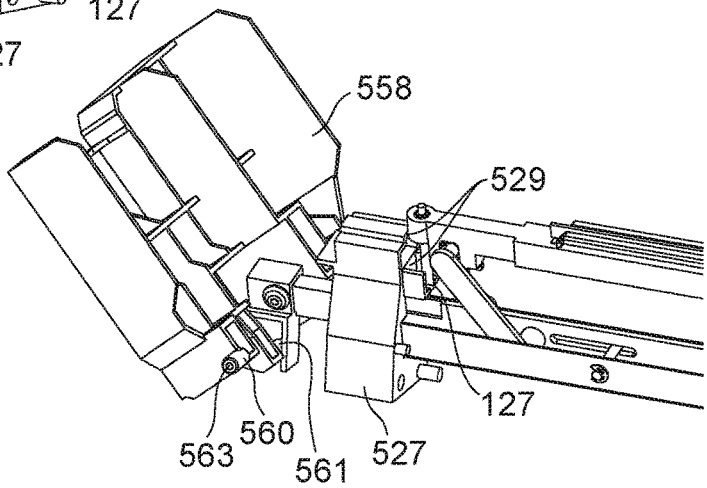
Figure 21C:
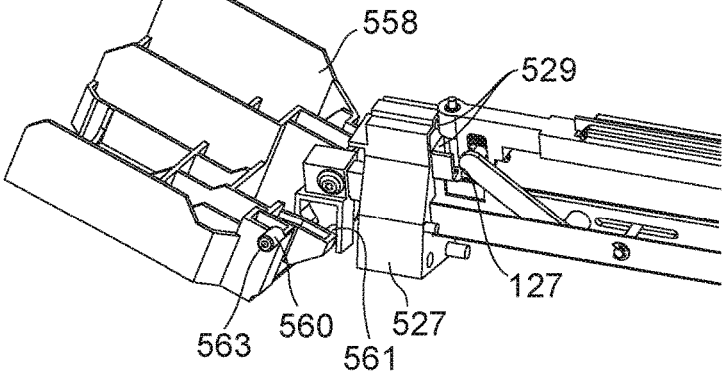
Figure 21D:
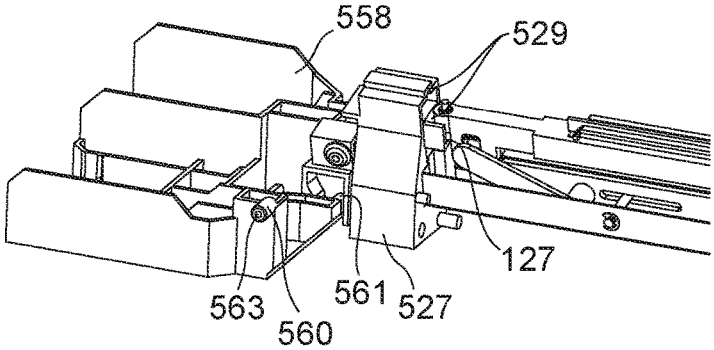
Figure 22A:
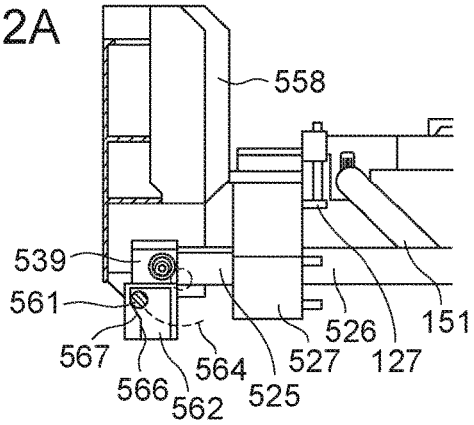
FIGS. 22A through 22D are side views of a cover, for description of operations when the cover is opened.

FIGS. 21A through 21D are perspective diagrams illustrating the cover 558 pivoting from the closed state toward the opened state. FIGS. 22A through 22D are cross-sectional views illustrating the cover 558 pivoting from the closed state toward the opened state. FIGS. 21A and 22A illustrate the closed state of the cover 558. FIGS. 21D and 22D illustrate the opened state of the cover 558. FIGS. 21B and 22B, and FIGS. 21C and 22C, are diagrams illustrating the cover 558 transitioning from the closed state to the opened state.

In the closed state of the cover 558 illustrated in FIG. 22A, force is placed on the sliding portion 525 via the first link mechanism 861 and second link mechanism 862 to slide from the front side toward the rear side, by the deadweight of the optical print head 105 and the restoring force of later-described springs. However, the cover 558 in the closed state is fixed to the main body of the image forming apparatus 1 so that the cover 558 does not pivot, and the pressing member 561 restricts movement of the slide aiding member 539 to the rear side, so the sliding portion 525 does not move by sliding to the rear side.

Figure 22B:
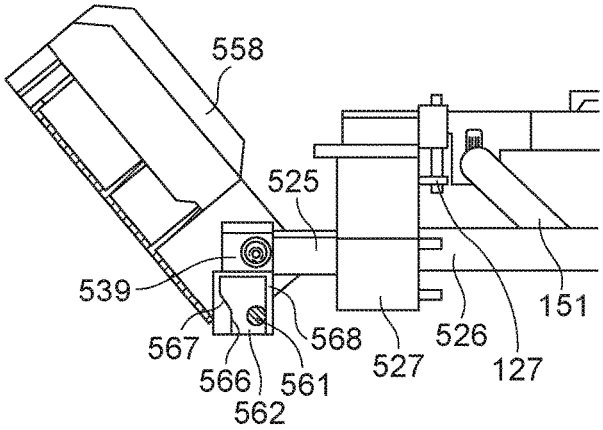
Figure 22C:
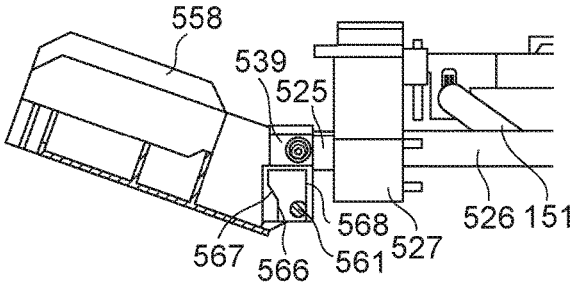
Figure 22D:
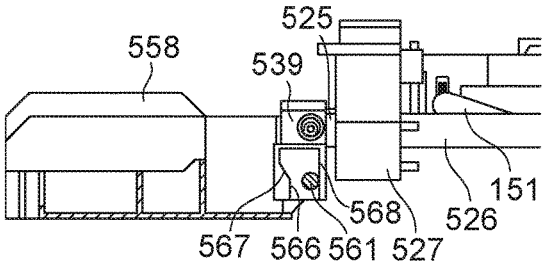

When the cover 558 pivots in the counter-clockwise direction from the state in FIG. 22A, the pressing member 561 abuts a third pressed portion 568, as illustrated in FIG. 22B. Upon the cover 558 further pivoting in the counter-clockwise direction from the state in FIG. 22B, the pressing member 561 presses the third pressed portion 568 from the front side toward the rear side as illustrated in FIGS. 22B and 22C, and the sliding portion 525 moves toward the rear side. Thereafter, further pivoting of the cover 558 in the counter-clockwise direction brings the cover 558 to the opened state as illustrated in FIG. 22D.

The mechanism where the pressing member 561 presses the third pressed portion 568 is provided from the following reason. That is to say, a case can be conceived where the sliding portion 525 does not move to the rear side even if restriction on movement of the slide aiding member 539 by the pressing member 561 is released by the cover 558 being pivoted in the counter-clockwise direction from the state in FIG. 21A, if frictional force between the link member 151 or link member 152 and the sliding portion 525, or frictional force between the between the sliding portion 525 and third support portion 526, are great. That is to say, a case can be conceived where the sliding portion 525 does not move by sliding even though the cover 558 has been opened. In order to deal with this, the movement mechanism according to the present embodiment includes the mechanism where the pressing member 561 presses the third pressed portion 568, so that opening the cover 558 causes the sliding portion 525 to move toward the rear side. According to the configuration described above, a worker performing maintenance opening and closing the cover 558 causes the sliding portion 525 to move by sliding with regard to the third support portion 526, in conjunction with movement of the cover 558.

Figure 23A:
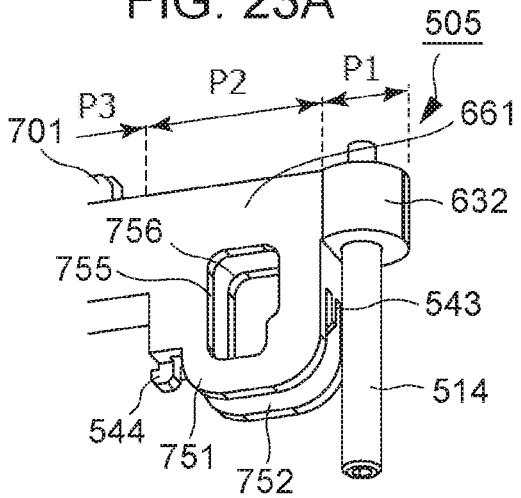
FIGS. 23A through 23D are perspective views for describing the structure of both ends of a holding member.
Figure 23B:
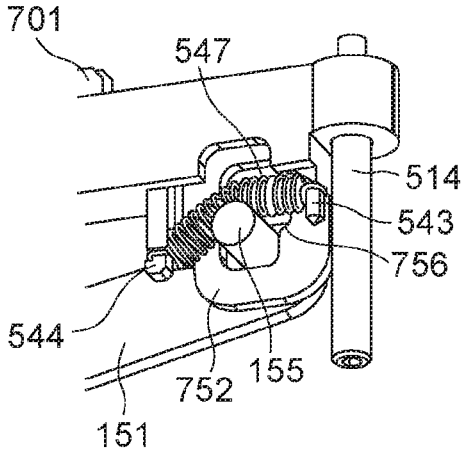
Figure 23C:
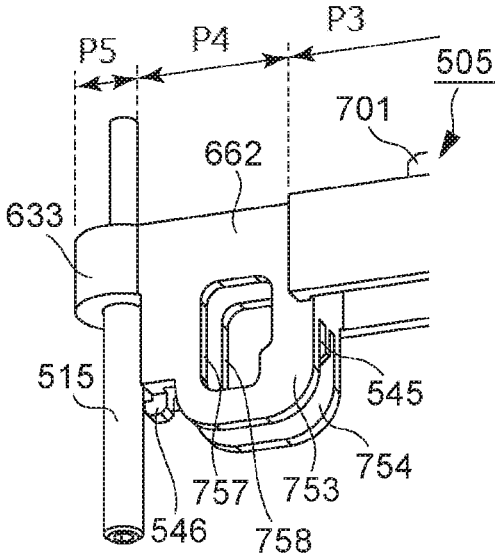
Figure 23D:
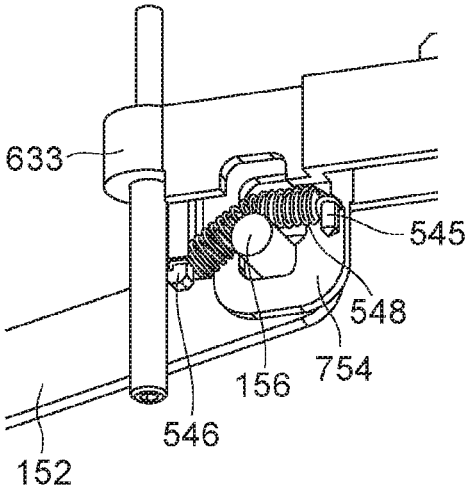

Next, a connection mechanism between the holding member 505 and the link member 151 will be described. FIGS. 23A and 23C are perspective views illustrating the one end side of the holding member 505 in the front-and-rear direction. FIGS. 23B and 23D are perspective views illustrating the other end side of the holding member 505 in the front-and-rear direction.

The holding member 505 is provided with the lens attaching portion 701 to which the lens array 506 is attached, the spring attaching portion 661 to which a coil spring 547 is attached, the spring attaching portion 662 to which a coil spring 548 is attached, the pin attaching portion 632 to which the abutting pin 514 is attached, and the pin attaching portion 633 to which the abutting pin 515 is attached, as illustrated in FIG. 23A. The holding member 505 is a resin molded article where the lens attaching portion 701, circuit board attaching portion 702 (omitted from illustration), spring attaching portion 661, and spring attaching portion 662, have been integrally molded by injection molding. The spring attaching portion 661 is disposed to the one end side of the lens attaching portion 701 in the front-and-rear direction, and further the pin attaching portion 632 is disposed further toward the end portion side of the holding member 505 than the spring attaching portion 661. The spring attaching portion 662 is disposed to the other end side of the lens attaching portion 701 in the front-and-rear direction, and the pin attaching portion 632 is disposed further toward the end portion side of the holding member 505 than the spring attaching position 662. The places where the lens attaching portion 701, spring attaching portion 661, and pin attaching portion 632 are formed in the holding member 505 are region P3, region P2, and region P1 in FIG. 23A. The holding member 505 is subjected to upwards biasing force from below, by the protrusion 155 of the link member 151 via the coil spring 547, at a position to the front side of the lens array 506 but to the rear side of the abutting pin 514. Also, the places where the lens attaching portion 701, spring attaching portion 662, and pin attaching portion 633 are formed in the holding member 505 are region P3, region P4, and region P5 in FIG. 23C. Biasing force is applied to the holding member 505 from the lower side toward the upper side by the protrusion 156 of the link member 152 via the coil spring 548, at a position to the rear side from the lens array 506 but to the front side from the abutting pin 515.

First, description will be made regarding the spring attaching portion 661. The spring attaching portion 661 includes a first wall portion 751, a second wall portion 752, a first engaging portion 543, and a second engaging portion 544. The first wall portion 751 is disposed to the one end side of the holding member 505 in the left-and-right direction, and the second wall portion 752 is disposed to the other end side of the holding member 505 in the left-and-right direction. The first wall portion 751 and second wall portion 752 are disposed to both sides of the abutting pin 514 in the left-and-right direction, in the present embodiment. The first wall portion 751 and second wall portion 752 each have an inner wall face facing each other, as illustrated in FIG. 23A. An opening 755 is formed in the first wall portion 751, and an opening 756 is formed in the second wall portion 752. The opening 755 and the opening 756 are slots extending in the vertical direction. The protrusion 155 is inserted to the opening 755 and opening 756. The protrusion 155 is not fit to the opening 755 and opening 756, and is inserted with a gap of around 0.5 mm even at the narrowest place in the front-and-rear direction. Accordingly, the direction of movement of the protrusion 155 is guided in the vertical direction by the opening 755 and opening 756, without any great frictional force being applied by the inner wall faces of the opening 755 and opening 756.

FIG. 23B is a diagram where the first wall portion 751 has been omitted from illustration in FIG. 23A. The first engaging portion 543 and second engaging portion 544 are disposed between the first wall portion 751 and second wall portion 752 in the left-and-right direction. This first engaging portion 543 and second engaging portion 544 also are respectively disposed on the front side and rear side of the opening 755 and opening 756 in the front-and-rear direction. The first engaging portion 543 is disposed further toward the end portion side of the holding member 505 than the second engaging portion 544 in the present embodiment. The first engaging portion 543 and second engaging portion 544 are protrusions that protrude downwards from connecting portions connecting the first wall portion 751 and second wall portion 752 of the holding member 505. One end of the coil spring 547 is engaged with the first engaging portion 543, and the other end of the coil spring 547 is engaged with the second engaging portion 544. The first engaging portion 543 and second engaging portion 544 are disposed at the spring attaching portion 661 such that the coil spring 547 that is engaged at the first engaging portion 543 and second engaging portion 544 traverses the opening 755 and opening 756.

The first engaging portion 543 and second engaging portion 544 are disposed at positions that are different from each other in the vertical direction. The first engaging portion 543 is disposed closer to the photosensitive drum 103 side than the second engaging portion 544 in the present embodiment. Note that an arrangement may be made where the first engaging portion 543 and second engaging portion 544 are generally the same in the vertical direction, and the second engaging portion 544 may be disposed closer to the photosensitive drum 103 side than the first engaging portion 543.

The protrusion 155 is inserted to the opening 756 of the second wall portion 752 from the outer wall face side thereof, passes beneath the coil spring 547 strung between the first engaging portion 543 and second engaging portion 544, and is inserted into the opening 755 of the first wall portion 751, as illustrated in FIG. 23B.

Next, description will be made regarding the spring attaching portion 662. The spring attaching portion 662 includes a third wall portion 753, a fourth wall portion 754, a third engaging portion 545, and a fourth engaging portion 546, as illustrated in FIG. 23C. The third wall portion 753 is disposed to the one end side of the holding member 505 in the left-and-right direction, and the fourth wall portion 754 is disposed to the other end side of the holding member 505 in the left-and-right direction. The third wall portion 753 and fourth wall portion 754 are disposed to both sides of the abutting pin 515 in the left-and-right direction, in the present embodiment. The first wall portion 751 and the third wall portion 753 are disposed on the same side in the left-and-right direction, i.e., the first wall portion 751 and the third wall portion 753 are disposed on the right side of the holding member 505 in the left-and-right direction. The second wall portion 752 and the fourth wall portion 754 are disposed on the same side in the left- and right direction, i.e., the second wall portion 752 and the fourth wall portion 754 are disposed on the left side of the holding member 505 in the left-and-right direction.

The third wall portion 753 and fourth wall portion 754 each have an inner wall face facing each other, as illustrated in FIG. 23C. An opening 757 is formed in the third wall portion 753, and an opening 758 is formed in the fourth wall portion 754. The opening 757 and the opening 758 are slots extending in the vertical direction. The protrusion 156 is inserted to the opening 757 and opening 758. The protrusion 156 is not fit to the opening 757 and opening 758, and is inserted with a gap of around 0.5 mm even at the narrowest place in the front-and-rear direction. Accordingly, the direction of movement of the protrusion 156 is guided in the vertical direction by the opening 757 and opening 758, without any great frictional force being applied by the inner wall faces of the opening 757 and opening 758.

FIG. 23D is a diagram where the third wall portion 753 has been omitted from illustration in FIG. 23C. The third engaging portion 545 and fourth engaging portion 546 are disposed between the third wall portion 753 and fourth wall portion 754 in the left-and-right direction. This third engaging portion 545 and fourth engaging portion 546 also are respectively disposed on the front side and rear side of the opening 757 and opening 758 in the front-and-rear direction. The fourth engaging portion 546 is disposed further toward the end portion side of the holding member 505 than the third engaging portion 545 in the present embodiment. The third engaging portion 545 and fourth engaging portion 546 are protrusions that protrude downwards from connecting portions connecting the third wall portion 753 and fourth wall portion 754 of the holding member 505. One end of the coil spring 548 is engaged with the third engaging portion 545, and the other end of the coil spring 548 is engaged with the fourth engaging portion 546. The third engaging portion 545 and fourth engaging portion 546 are disposed at the spring attaching portion 662 such that the coil spring 548 that is engaged at the third engaging portion 545 and fourth engaging portion 546 traverses the opening 757 and opening 758.

The third engaging portion 545 and fourth engaging portion 546 are disposed at positions that are different from each other in the vertical direction. The third engaging portion 545 is disposed closer to the photosensitive drum 103 side than the fourth engaging portion 546 in the present embodiment. Note that an arrangement may be made where the third engaging portion 545 and fourth engaging portion 546 are generally the same in the vertical direction, and the fourth engaging portion 546 may be disposed closer to the photosensitive drum 103 side than the third engaging portion 545.

The protrusion 156 is inserted to the opening 758 of the fourth wall portion 754 from the outer wall face side thereof, passes beneath the coil spring 548 strung between the third engaging portion 545 and fourth engaging portion 546, and is inserted into the opening 757 of the third wall portion 753, as illustrated in FIG. 23D. Although a coil spring has been described as an example of the coil spring 547 and coil spring 548 in the present embodiment, plate springs may be used instead.

Next, the operations of the protrusion 155 provided to the link member 151 on the coil spring 547, and the operations of the protrusion 156 provided to the link member 152 on the coil spring 548, will be described with reference to FIGS. 24A through 24C. The operations of the protrusion 155 on the coil spring 547 and the operations of the protrusion 156 on the coil spring 548 are the same, so the operations of the protrusion 156 on the coil spring 548 will be exemplified in FIGS. 24A through 24C.

Figure 24A:
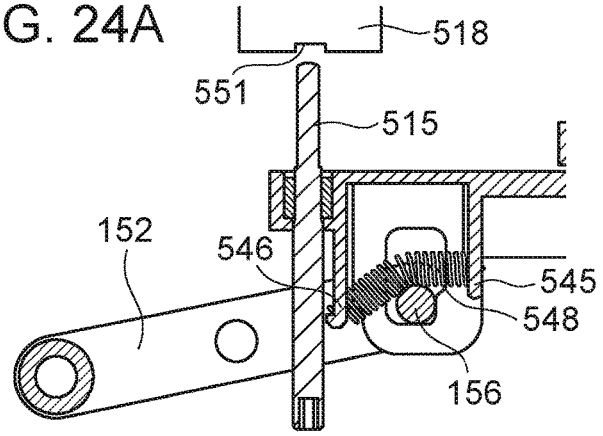
FIGS. 24A through 24C are perspective views for describing the structure of the other end of the holding member.

FIG. 24A is a diagram illustrating a state where the abutting pin 515 provided to the holding member 505 is retracted from the abutting face 551 of the drum unit 518. FIG. 24B is a diagram illustrating the point of the abutting pin 515 abutting the abutting face 551 of the drum unit 518. FIG. 24C is a diagram illustrating a state where the link member 152 has pivoted in the counter-clockwise direction from the state in FIG. 24B.

Upon the sliding portion 525 moving by sliding in the state in FIG. 24A, the link member 152 pivots in the counter-clockwise direction in conjunction therewith, and the protrusion 156 moves upwards. At this time, the protrusion 156 presses the coil spring 548 upwards. The protrusion 156 pressing the coil spring 548 upwards causes upward force to be applied to the holding member 505 via the third engaging portion 545 and fourth engaging portion 546. The abutting pin 515 is not in contact with the drum unit 518, and there is no force countering the force of the protrusion 156 pressing the coil spring 548, other than the gravity acting on the optical print head 105. Accordingly, when the upward force acting on the third engaging portion 545 and the fourth engaging portion 546 exceeds the gravity acting on the optical print head 105, the holding member 505 moves upwards by the force acting on the third engaging portion 545 and fourth engaging portion 546. Now, an arrangement may be made where, when the holding member 505 is in the retracted position, the lower end of the abutting pin 515 (514) and the holding member 505 are supported by the apparatus main body, and the protrusion 156 (155) of the link member 152 (151) is not in contact with the coil spring 548 (547).

Figure 24B:
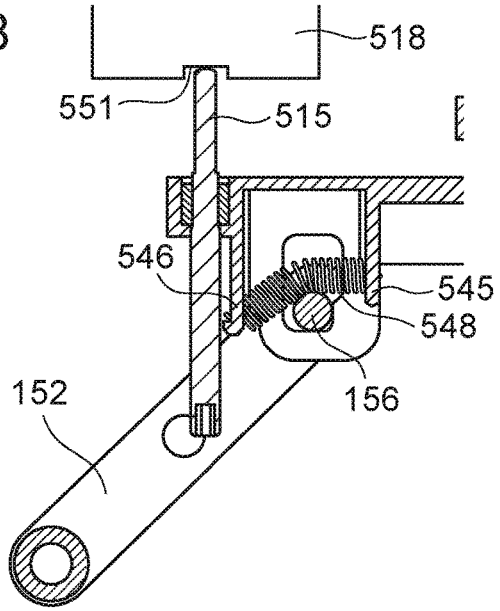

When the holding member 505 moves upwards, the abutting pin 515 abuts the abutting face 551 of the drum unit 518 as illustrated in FIG. 24B. In FIG. 24B, the optical print head 105 is situated at the exposure position, but the biasing force acting to the optical print head 105 to bias the optical print head 105 against the drum unit 518 is insufficient. Accordingly, the movement mechanism 140 according to the present embodiment has a configuration where the link member 152 is capable of further pivoting from the state in FIG. 24B, to apply the biasing force to the optical print head 105.

Further pivoting the link member 152 in the counter-clockwise direction from the state in FIG. 24B does not change the position of the holding member 505, since the abutting pin 515 is already abutting the abutting face 551 of the drum unit 518. On the other hand, the protrusion 156 moves upwards, so the coil spring 548 is pressed by the protrusion 156 passing between the third engaging portion 545 and fourth engaging portion 546, and flexes and stretches as illustrated in FIG. 24C.

Figure 24C:
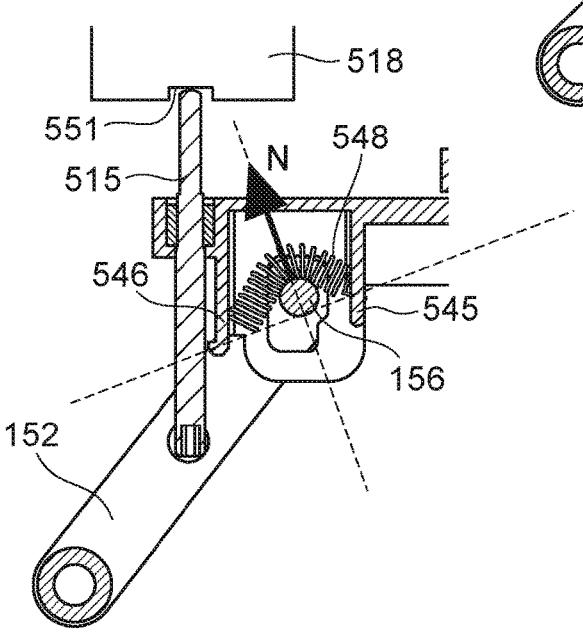

The state in FIG. 24C corresponds to the state of the cover 558 in FIGS. 20C and 20D. That is to say, the sliding portion 525 is in a state where there is no further movement by sliding toward the front side. Accordingly, the link member 152 does not pivot further in the counter-clockwise direction from the state in FIG. 24C, since the sliding portion 525 does not move by sliding, and the protrusion 156 does not move upwards and is stationary at the position in FIG. 24C. The contracting force of the coil spring 548 acts on the third engaging portion 545 and fourth engaging portion 546 in this state. A force component of the contracting force of the coil spring 548 acting on the third engaging portion 545 and fourth engaging portion 546 is directed upwards, so biasing force acts on the holding member 505 to bias the holding member 505 toward the drum unit 518 side, and the holding member 505 is biased against the drum unit 518 via the abutting pin 515.

As described above, the third engaging portion 545 is disposed closer to the photosensitive drum 103 side than the fourth engaging portion 546, so normal force in the direction of the arrow N acts on the coil spring 548 from the protrusion 156. The force component of the normal force in the direction of the arrow N acts on the holding member 505. Accordingly, force toward the rear side in the front-and-rear direction acts on the abutting pin 515, and the abutting pin 515 abutting the abutting face 551 is biased against and abuts the rear-side wall face 596 at the deepest part of the fitting portion 685. The reason why the first engaging portion 543 is disposed closer to the photosensitive drum 103 side than the second engaging portion 544 is also the same.

First Modification

An example of the way in which the coil spring 547 and coil spring 548 are attached to the spring attaching portion 661 and spring attaching portion 662 will be described with reference to FIGS. 25A and 25B, as a first modification. Note that members having substantially the same function as those in the movement mechanism 140 are denoted by the same reference numerals in the description, and redundant description may be omitted.

Figure 25A:
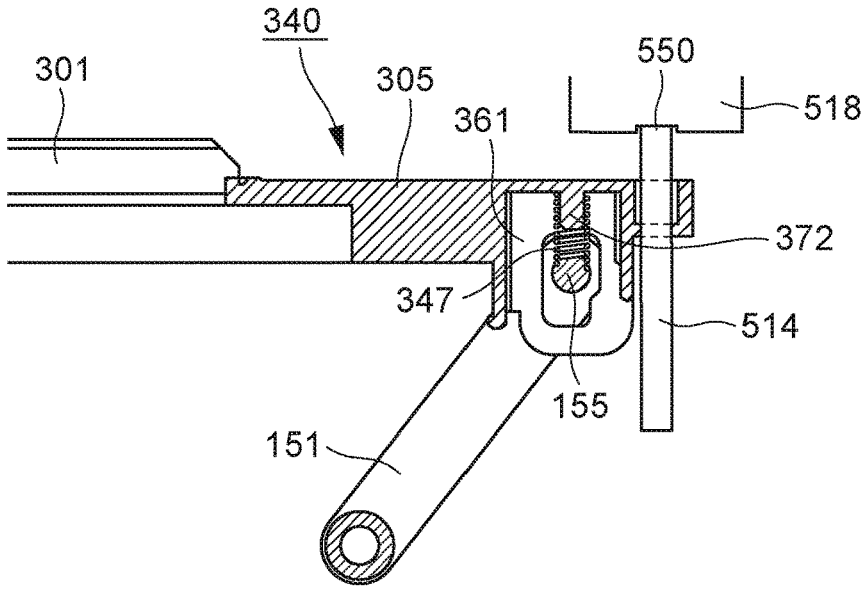
FIGS. 25A and 25B are diagrams for describing a movement mechanism according to a first modification.
Figure 25B:
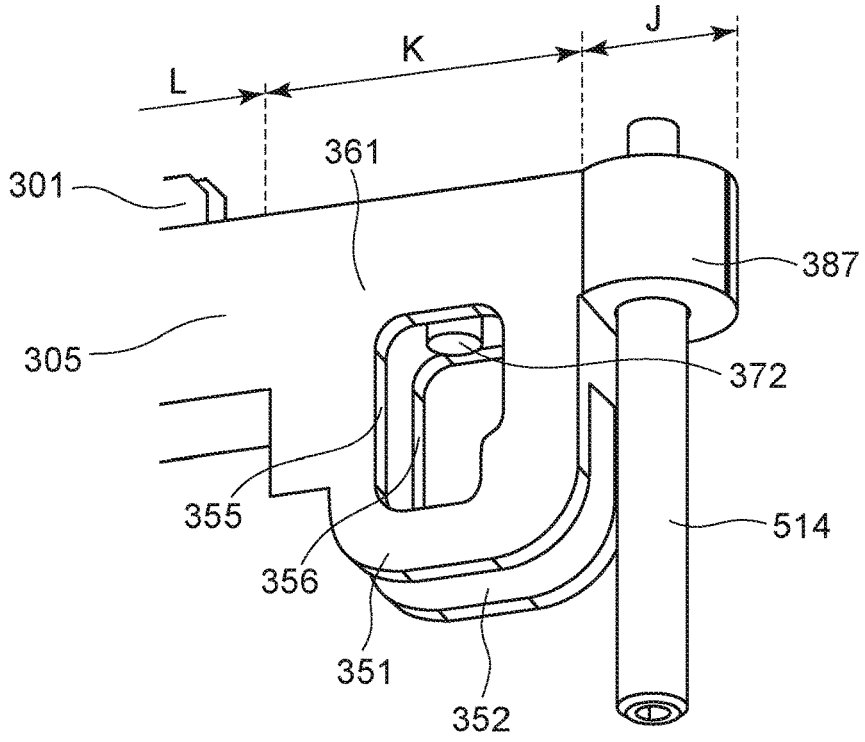

A holding member 305 illustrated in FIGS. 25A and 25B includes a lens attaching portion 301 to which the lens array 506 is attached, a spring attaching portion 361 to which a coil spring 347 is attached, and a pin attaching portion 387 to which the abutting pin 514 is attached. Note that FIGS. 20A and 20B only illustrate the front side of the holding member 305, so the spring attaching portion 362 to which the coil spring 348 is attached, and the pin attaching portion 388 to which the abutting pin 515 is attached, are not illustrated. The holding member 305 is an integral molded article, where the lens attaching portion 301, circuit board attaching portions 702 (omitted from illustration), spring attaching portion 361, spring attaching portion 362, and pin attaching portion 387, and pin attaching portion 388, have been formed by injection molding. The spring attaching portion 361 is disposed closer to the one end side of the holding member 305 than the lens attaching portion 301 in the front-and-rear direction, and the pin attaching portion 387 is disposed further toward the end side of the holding member 305 than the spring attaching portion 361. Also, the spring attaching portion 362 is disposed closer to the other end side of the holding member 305 than the lens attaching portion 301 in the front-and-rear direction, and the pin attaching portion 388 is disposed further toward the end side of the holding member 305 than the spring attaching portion 362.

The spring attaching portion 361 will be described with reference to FIG. 25B. The spring attaching portion 361 has a first wall portion 351, a second wall portion 352, and an engaging portion 372. The places where the lens attaching portion 301, spring attaching portion 361, and pin attaching portion 387 are formed respectively are region L, region K, and region J in FIG. 25B. The holding member 305 is applied with biasing force upwards by the protrusion 155 of the link member 151 from blow, via the coil spring 347 at a position further toward the front side from the lens array 506 and toward the rear side from the abutting pin 514 in FIGS. 25A and 25B. The first wall portion 351 is disposed at the one end side of the holding member 305 in the left-and-right direction, and the second wall portion 352 is disposed at the other end side of the holding member 305 in the left-and-right direction. The first wall portion 351 and second wall portion 352 are formed on both sides of the abutting pin 514 in the left- and right direction in the present modification. An opening 355 is formed in the first wall portion 351, and an opening 356 is formed in the second wall portion 352. The opening 355 and the opening 356 are slots extending in the vertical direction. The protrusion 155 is inserted to the opening 355 and opening 356 in that order from the left side of the holding member 305. The protrusion 155 is not fit to the opening 355 and opening 356, and is inserted with a gap of around 0.5 mm even at the narrowest place in the front-and-rear direction. Accordingly, the direction of movement of the protrusion 155 is guided in the vertical direction by the opening 355 and opening 356, without any great frictional force being applied by the inner wall faces of the opening 355 and opening 356. The engaging portion 372 is a cylindrical protrusion erected downwards from above between the first wall portion 351 and second wall portion 352, as illustrated in FIG. 25B. The one end of the coil spring 347 is inserted to the engaging portion 372, upwards from below, as illustrated in FIG. 25A. The other end of the coil spring 347 comes into contact with the protrusion 155. That is to say, the contact portion between the other end side of the coil spring 347 and the protrusion 155 is situated at a lower side than the contact portion between the one end side of the coil spring 347 and the engaging portion 372.

FIG. 25A illustrates a state immediately after the optical print head 105 has moved from the retracted position toward the exposure position and the abutting pin 514 has come into contact with an abutting face 550. The optical print head 105 is situated at the exposure position, but the biasing force acting on the optical print head 105 to bias the optical print head 105 against the drum unit 518 is insufficient. Accordingly, the movement mechanism 340 according to the present modification has a configuration where the link member 151 is capable of further pivoting from the state in FIG. 25A, to apply the biasing force to the optical print head 105.

Further pivoting the link member 151 in the counter-clockwise direction from the state in FIG. 25A does not change the position of the holding member 305, since the abutting pin 514 is already abutting the abutting face 550 of the drum unit 518. On the other hand, the protrusion 155 moves upwards, so the coil spring 547 is compressed between the engaging portion 372 and the protrusion 155.

The state in which the link member 151 has been further pivoted in the counter-clockwise direction from the state in FIG. 25A corresponds to the state of the cover 558 in FIGS. 17C and 17D, and FIGS. 20C and 20D. That is to say, the sliding portion 525 is in a state where there is no further movement by sliding toward the front side. Accordingly, the link member 151 does not pivot further in the counter-clockwise direction since the sliding portion 525 does not move by sliding, and the protrusion 155 does not move upwards and is stationary. The restoring force of the compressed coil spring 347 in this state acts as biasing force on the holding member 305 to bias the holding member 305 toward the drum unit 518 side, and the holding member 305 is biased against the drum unit 518 via the abutting pin 515. A configuration may also be made where, when the holding member 305 is at the retracted position, the lower end of the abutting pin 514 (515) and the holding member 305 are supported by the apparatus main body, so that the protrusion 155 (156) of the link member 151 (152) is not in contact with the coil spring 347 (348).

Second Modification

Another modification regarding the way in which a coil spring 447 is attached to a holding member 405 will be described with reference to FIGS. 26A and 26B. A holding member 405 illustrated in FIGS. 26A and 26B includes a lens attaching portion 401 to which the lens array 506 is attached, a spring attaching portion 461 to which the coil spring 447 is attached, and a pin attaching portion 487 to which the abutting pin 514 is attached. Note that FIG. 26B only illustrates the front side of the holding member 405. The holding member 405 is an integral molded article where the lens attaching portion 401, circuit board attaching portions 702 (omitted from illustration), spring attaching portion 461, and pin attaching portion 487, have been formed by injection molding. The spring attaching portion 461 is disposed closer to the one end side of the holding member 405 than the lens attaching portion 401 in the front-and-rear direction, and the pin attaching portion 487 is disposed further toward the end side of the holding member 405 than the spring attaching portion 461.

The spring attaching portion 461 will be described with reference to FIG. 26B. The spring attaching portion 461 has a first wall portion 451, a second wall portion 452, and an engaging portion 472. The places where the lens attaching portion 401, spring attaching portion 461, and pin attaching portion 487 are formed respectively are region O, region N, and region M in FIG. 26B. Biasing force is applied to the holding member 405 in the upward direction from below, by the protrusion 155 of the link member 151 via the coil spring 447, at a position further toward the front side than the lens array 506 and further toward the rear side from the abutting pin 514, as illustrated in FIGS. 26A and 26B. The first wall portion 451 is disposed at the one end side of the holding member 405 in the left-and-right direction, and the second wall portion 452 is disposed at the other end side of the holding member 405 in the left-and-right direction. The first wall portion 451 and second wall portion 452 are formed on both sides of the abutting pin 514 in the left-and-right direction in the present modification. An opening 455 is formed in the first wall portion 451, and an opening 456 is formed in the second wall portion 452. The opening 455 and the opening 456 are slots extending in the vertical direction. The protrusion 155 is inserted to the opening 455 and opening 456, from the left side of the holding member 405, in that order. The protrusion 155 is not fit to the opening 455 and opening 456, as illustrated in FIG. 26A, and is inserted with a gap of around 0.5 mm even at the narrowest place in the front-and-rear direction. Accordingly, the direction of movement of the protrusion 155 is guided in the vertical direction by the opening 455 and opening 456, without any great frictional force being applied by the inner wall faces of the opening 455 and opening 456. The engaging portion 472 is inserted from a hole formed in the first wall portion 451 toward the second wall portion 452, below the opening 455 of the first wall portion 451 and the opening 456 of the second wall portion 452 as illustrated in FIG. 26B, and is fixed to the first wall portion 451. The other end of the coil spring 447 is engaged with the engaging portion 472, between the first wall portion 451 and second wall portion 452, as illustrated in FIG. 26A. The one end side of the coil spring 447 is connected to the protrusion 155 so as to be capable of pivoting. That is to say, the contact portion between the other end side of the coil spring 447 and the protrusion 155 is situated at a higher side than the contact portion between the one end side of the coil spring 447 and the engaging portion 472.

Figure 26A:
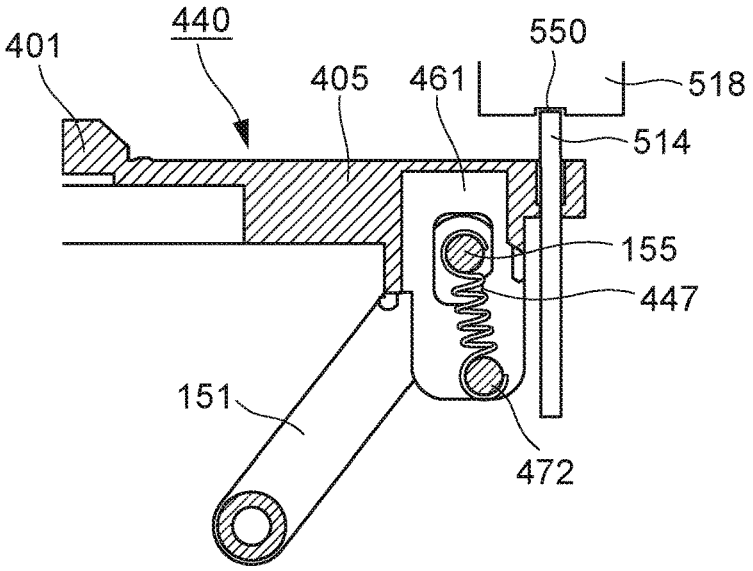
FIGS. 26A and 26B are diagrams for describing a movement mechanism according to a second modification.
Figure 26B:
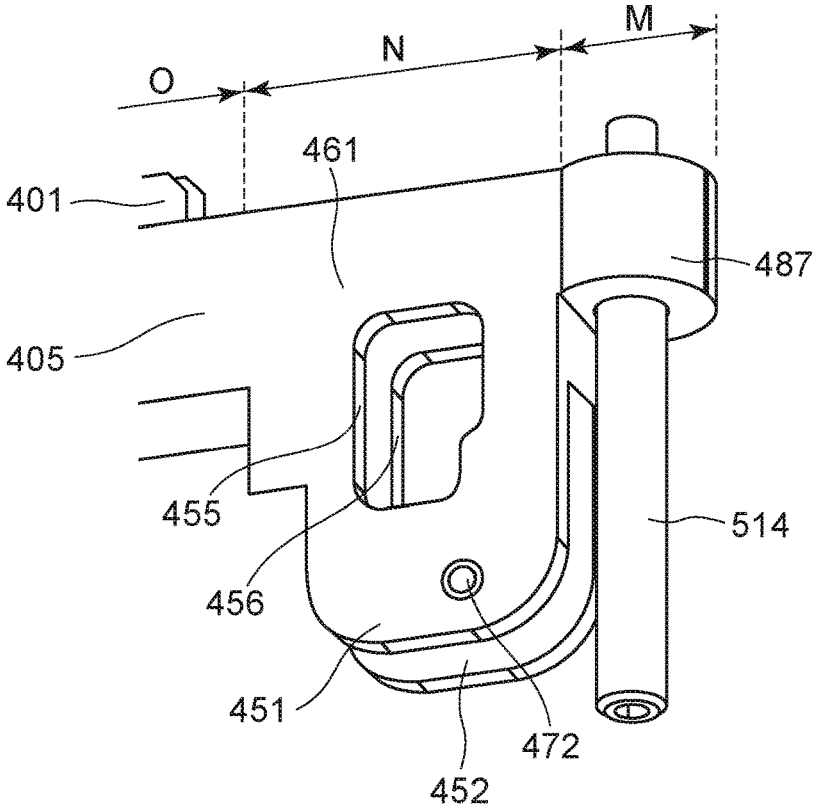

FIG. 26A illustrates a state immediately after the optical print head 105 has moved from the retracted position toward the exposure position and the abutting pin 514 has come into contact with an abutting face 550. The optical print head 105 is situated at the exposure position, but the biasing force acting on the optical print head 105 to bias the optical print head 105 against the drum unit 518 is insufficient. Accordingly, the movement mechanism 440 according to the present modification has a configuration where the link member 151 is capable of further pivoting from the state in FIG. 26A, to apply the biasing force to the optical print head 105.

Further pivoting the link member 151 in the counter-clockwise direction from the state in FIG. 26A does not change the position of the holding member 405, since the abutting pin 514 is already abutting the abutting face 550 of the drum unit 518. On the other hand, the protrusion 155 moves upwards, so the coil spring 447 is stretched by the engaging portion 472 and the protrusion 155.

The state in which the link member 151 has been further pivoted in the counter-clockwise direction from the state in FIG. 26A corresponds to the state of the cover 558 in FIGS. 17C and 17D, and FIGS. 20C and 20D. That is to say, the sliding portion 525 is in a state where there is no further movement by sliding toward the front side. Accordingly, the link member 151 does not pivot further in the counter-clockwise direction since the sliding portion 525 does not move by sliding, and the protrusion 155 does not move upwards and is stationary. The restoring force of the stretched coil spring 447 in this state acts as biasing force on the holding member 405 to bias the holding member 405 toward the drum unit 518 side, and the holding member 405 is biased against the drum unit 518 via the abutting pin 514. Note that a structure may be made where the coil spring 447 is directly stretched by the upper end portion of the link member 151 rather than the protrusion 155, i.e., the first moving portion may be the upper end portion of the link member 151.

As described above, in the image forming apparatus 1 according to the above-described embodiment and modifications, the abutting pin 514 or abutting pin 515 restricts the holding member 505 from moving to a direction intersecting the rotational axis direction of the photosensitive drum 103 and the direction in which the optical print head 105 reciprocally moves between the exposure position and the retracted position, at the other side thereof as to the side where the drum unit 518 is disposed. Accordingly, movement of the optical print head 105 in a direction intersecting the rotational axis direction of the photosensitive drum 103 and the direction of reciprocal movement between the exposure position and the retracted position is restricted.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-119000, filed Jun. 16, 2017, which is hereby incorporated by reference herein in its entirety.

What is claimed is:

1. An image forming apparatus having a drum unit rotatably supporting a photosensitive drum, the image forming apparatus comprising:

an optical print head configured to expose the photosensitive drum;

a movement mechanism configured to move the optical print head between an exposure position where the optical print head exposes the photosensitive drum, and a retracted position retracted further from the photosensitive drum than the exposure position;

a first abutting pin that is provided on a one end side of the optical print head in a longitudinal direction of the optical print head and protrudes from a side where the photosensitive drum is arranged of the optical print head and a side opposite to a side where the photosensitive drum is arranged of the optical print head and that is configured to be abutted against the drum unit; and a second abutting pin that is provided on an other end side of the optical print head in the longitudinal direction of the optical print head and protrudes from a side where the photosensitive drum is arranged of the optical print head and a side opposite to a side where the photosensitive drum is arranged of the optical print head, and that is configured to be abutted against a second abutted portion formed on the other end side of the drum unit in the longitudinal direction to position the other end side of the optical print head in the longitudinal direction as to the drum unit, wherein the movement mechanism includes a first moving member including a first supporting portion for supporting the optical print head at a position where the first supporting portion overlaps with the first abutting pin in the longitudinal direction of the optical print head, and moves the optical print head, and a second moving member including a second supporting portion for supporting the optical print head at a position where the second supporting portion overlaps with the second abutting pin in the longitudinal direction of the optical print head and moves the optical print head.

2. The image forming apparatus according to claim 1, wherein the movement mechanism reciprocally moves the optical print head between the exposure position and the retracted position, and wherein a reciprocation direction is the same as a longitudinal direction of the first abutting pin and a longitudinal direction of the second abutting pin.

3. The image forming apparatus according to claim 2, further comprising:

a restrict portion fixed to a main assembly of the image forming apparatus as a separate member from the optical print head at an opposite side opposite to a side where the drum unit is arranged with respect to the optical print head, and configured to restrict movement of the first abutting pin in a perpendicular direction, which is perpendicular to both the longitudinal direction of the optical print head and the reciprocation direction, wherein the restrict portion includes a first facing portion located at one side rather than the first abutting pin in the perpendicular direction and facing the first abutting pin in the perpendicular direction, and a second facing portion located at the other side rather than the first abutting pin in the perpendicular direction and facing the first abutting pin in the perpendicular direction, and wherein the first abutting pin moved together with the optical print head from the retracted position to the exposure position by the movement mechanism comes into contact with the first facing portion to restrict the movement of the first abutting pin moving from the other side to the one side and comes into contact with the second facing portion to restrict the movement of the first abutting pin moving from the one side to the other side.

4. The image forming apparatus according to claim 3, wherein the first facing portion and the second facing portion are a protrusion configured to protrude toward the first abutting pin from a downstream side from the first abutting pin, in a direction heading from an other end side of the optical print head in the longitudinal direction of the optical print head toward one end side of the optical print head in the longitudinal direction of the optical print head.

5. The image forming apparatus according to claim 2, further comprising:

a restrict portion fixed to a main assembly of the image forming apparatus as a separate member from the optical print head at an opposite side opposite to a side where the drum unit is arranged with respect to the optical print head, and configured to restrict movement of the second abutting pin in a perpendicular direction, which is perpendicular to both the longitudinal direction of the optical print head and the reciprocation direction, wherein the restrict portion includes a first facing portion located at one side rather than the second abutting pin in the perpendicular direction and facing the second abutting pin in the perpendicular direction, and a second facing portion located at the other side rather than the second abutting pin in the perpendicular direction and facing the second abutting pin in the perpendicular direction, and wherein the second abutting pin moved together with the optical print head from the retracted position to the exposure position by the movement mechanism comes into contact with the first facing portion to restrict the movement of the second abutting pin moving from the other side to the one side and comes into contact with the second facing portion to restrict the movement of the second abutting pin moving from the one side to the other side.

6. The image forming apparatus according to claim 5, wherein the first facing portion and the second facing portion are a protrusion configured to protrude toward the second abutting pin from a downstream side from the second abutting pin, in a direction heading from one end side of the optical print head in the longitudinal direction of the optical print head toward an other end side of the optical print head in the longitudinal direction of the optical print head.

7. The image forming apparatus according to claim 1, wherein the first abutting pin is a straight pin extending straight, and the second abutting pin is also a straight pin extending straight.

8. The image forming apparatus according to claim 1, wherein the drum unit includes a first abutted portion that is a recess into which the drum unit side end portion of the first abutting pin fits, and a second abutted portion that is a recess into which the drum unit side end portion of the second abutting pin fits, wherein movement in a direction intersecting the longitudinal direction of the first abutting pin that has fit to the first abutted portion is restricted by the first abutted portion, and movement in a direction intersecting the longitudinal direction of the second abutting pin that has fit to the second abutted portion is restricted by the second abutted portion.

9. The image forming apparatus according to claim 1, wherein the optical print head has a lens array which emits light to expose the photosensitive drum, wherein the first moving member supports the optical print head at the downstream side of the lens array in a direction heading from an other end side of the optical print head in the longitudinal direction of the optical print head toward one end side of the optical print head in the longitudinal direction of the optical print head, and wherein the second moving member supports the optical print head at the downstream side of the lens array in a direction heading from the one end side of the optical print head in the longitudinal direction of the optical print head toward the other end side of the optical print head in the longitudinal direction of the optical print head.

10. The image forming apparatus according to claim 9, wherein the first moving member supports the optical print head between the lens array and the first abutting pin in the longitudinal direction of the optical print head, and wherein the second moving member supports the optical print head between the lens array and the second abutting pin in the longitudinal direction of the optical print head.

11. The image forming apparatus according to claim 1, further comprising:

a sliding portion configured to move by sliding in the longitudinal direction of the optical print head, wherein one end side of the first moving member in a longitudinal direction of the first moving member is pivotably attached to one end side of the optical print head in the longitudinal direction of the optical print head, wherein the other end side of the first moving member in the longitudinal direction of the first moving member is pivotably attached to one end side of the sliding portion in the longitudinal direction of the sliding portion, wherein one end side of the second moving member in a longitudinal direction of the second moving member is pivotably attached to the other end side of the optical print head in the longitudinal direction of the optical print head, wherein the other end side of the second moving member in the longitudinal direction of the second moving member is pivotably attached to the other end side of the sliding portion in a longitudinal direction of the sliding portion, and wherein the first moving member and the second moving member pivot as to the sliding portion, in conjunction with sliding movement of the sliding portion, and move the optical print head to the exposure position and the retracted position in conjunction with the pivoting.

12. The image forming apparatus according to claim 1, wherein the optical print head is disposed to a lower side of a rotational axis of the photosensitive drum in a vertical direction, and exposes the photosensitive drum from below.

13. An image forming apparatus having a drum unit rotatably supporting a photosensitive drum, the image forming apparatus comprising:

an optical print head configured to expose the photosensitive drum;

a movement mechanism configured to move the optical print head between an exposure position where the optical print head exposes the photosensitive drum and a retracted position retracted further from the photosensitive drum than the exposure position;

a first abutting pin that is provided on one end side of the optical print head in a longitudinal direction of the optical print head and protrudes from a side where the photosensitive drum is arranged of the optical print head and a side opposite to a side where the photosensitive drum is arranged of the optical print head, and that is configured to be abutted against the drum unit; and a second abutting pin that is provided on an other end side of the optical print head in the longitudinal direction of the optical print head and protrudes from a side where the photosensitive drum is arranged of the optical print head and a side opposite to a side where the photosensitive drum is arranged of the optical print head, and that is configured to be abutted against the drum unit, wherein the movement mechanism includes a first moving member including a first supporting portion for supporting the optical print head at a position where the first supporting portion overlaps with the first abutting pin in a direction perpendicular to a longitudinal direction of the first abutting pin, and moves the optical print head, and a second moving member including a second supporting portion for supporting the optical print head at a position where the second supporting portion overlaps with the second abutting pin in a direction perpendicular to a longitudinal direction of the second abutting pin, and moves the optical print head.

14. The image forming apparatus according to claim 13, wherein the movement mechanism reciprocally moves the optical print head between the exposure position and the retracted position, and wherein a reciprocation direction is the same as the longitudinal direction of the first abutting pin and the longitudinal direction of the second abutting pin.

15. The image forming apparatus according to claim 13, wherein the first abutting pin is a straight pin extending straight, and the second abutting pin is also a straight pin extending straight.

16. The image forming apparatus according to claim 13, wherein the drum unit includes a first abutted portion that is a recess into which the drum unit side end portion of the first abutting pin fits, and a second abutted portion that is a recess into which the drum unit side end portion of the second abutting pin fits, wherein movement in a direction intersecting the longitudinal direction of the first abutting pin that has fit to the first abutted portion is restricted by the first abutted portion, and movement in a direction intersecting the longitudinal direction of the second abutting pin that has fit to the second abutted portion is restricted by the second abutted portion.

17. The image forming apparatus according to claim 13, wherein the optical print head has a lens array which emits light to expose the photosensitive drum, wherein the first moving member supports the optical print head at the downstream side of the lens array in a direction heading from an other end side of the optical print head in the longitudinal direction of the optical print head toward one end side of the optical print head in the longitudinal direction of the optical print head, and wherein the second moving member supports the optical print head at the downstream side of the lens array in a direction heading from the one end side of the optical print head in the longitudinal direction of the optical print head toward the other end side of the optical print head in the longitudinal direction of the optical print head.

18. The image forming apparatus according to claim 17, wherein the first moving member supports the optical print head between the lens array and the first abutting pin in the longitudinal direction of the optical print head, and wherein the second moving member supports the optical print head between the lens array and the second abutting pin in the longitudinal direction of the optical print head.

19. The image forming apparatus according to claim 13, further comprising:

a sliding portion configured to move by sliding in the longitudinal direction of the optical print head, wherein one end side of the first moving member in a longitudinal direction of the first moving member is pivotably attached to one end side of the optical print head in the longitudinal direction of the optical print head, wherein the other end side of the first moving member in the longitudinal direction of the first moving member is pivotably attached to one end side of the sliding portion in a longitudinal direction of the sliding portion, wherein one end side of the second moving member in a longitudinal direction of the second moving member is pivotably attached to the other end side of the optical print head in the longitudinal direction of the optical print head, wherein the other end side of the second moving member in the longitudinal direction of the second moving member is pivotably attached to the other end side of the sliding portion in a longitudinal direction of the sliding portion, and wherein the first moving member and the second moving member pivot as to the sliding portion, in conjunction with sliding movement of the sliding portion, and move the optical print head to the exposure position and the retracted position in conjunction with the pivoting.

20. The image forming apparatus according to claim 13, wherein the optical print head is disposed to a lower side of the rotational axis of the photosensitive drum in the vertical direction, and exposes the photosensitive drum from below.

* * * * *